United States Patent [19]

Shaw

[11] 4,197,719

[45] Apr. 15, 1980

[54] TRI-LEVEL MULTI-CYLINDER RECIPROCATING COMPRESSOR HEAT PUMP SYSTEM

[75] Inventor: David N. Shaw, Unionville, Conn.

[73] Assignee: Dunham-Bush, Inc., West Hartford, Conn.

[21] Appl. No.: 882,729

[22] Filed: Mar. 2, 1978

Related U.S. Application Data

[63] Continuation-in-part of Ser. No. 806,407, Jun. 14, 1977, Pat. No. 4,148,436, which is a continuation-in-part of Ser. No. 782,675, Mar. 30, 1977, Pat. No. 4,086,072, which is a continuation-in-part of Ser. No. 653,568, Jan. 29, 1976, Pat. No. 4,058,988.

[51] Int. Cl.[2] ..... F25B 13/00

[52] U.S. Cl. ..... 62/324; 62/505; 62/513

[58] Field of Search ..... 236/1 E; 237/2 B; 62/117, 196 A, 324, 513, 228

[56] References Cited

U.S. PATENT DOCUMENTS

| | | | |
|---|---|---|---|
| 3,859,814 | 1/1975 | Grant | 62/196 A |
| 4,030,312 | 6/1977 | Wallin et al. | 62/324 |
| 4,102,149 | 7/1978 | Conley et al. | 62/196 A |

*Primary Examiner*—William E. Wayner

*Attorney, Agent, or Firm*—Sughrue, Rothwell, Mion, Zinn and Macpeak

[57] ABSTRACT

A multi-cylinder reciprocating compressor is automatically controlled in terms of two speed operation and selective utilization of the cylinders under single stage action to meet heating and cooling loads by way of a two step indoor thermostat and an outdoor thermostat. The compressor may supply energy to storage during heating and cooling or receive energy therefrom with the storage coil selectively loop connected to the outside or indoor coils. Subcooling return is directed to a specific cylinder and overrides refrigerant return vapor to that cylinder from other coils functioning as evaporators. Solenoid operated valves effect unloading of the compressor during start up and automatically effect removal or inclusion of selected cylinders to the single stage compressor operation. Automatic load responsive control of compressor drive motor speed is effected.

29 Claims, 11 Drawing Figures

4-WAY HEATING MODE/LOW SPEED
1st STEP

HEATING MODE
DUAL HEAT SOURCE

OUTSIDE AIR TO STORAGE

COOLING MODE
STORAGE SUPPLIED

HEAT REJECTION VIA OUTSIDE COIL FROM STORAGE COOLING MODE

COOLING MODE
REJECT TO OUTSIDE AIR

HEATING MODE
STORAGE SOURCE ONLY

STORAGE TO OUTSIDE AIR

TRI-LEVEL MULTI-CYLINDER RECIPROCATING COMPRESSOR HEAT PUMP SYSTEM

This application is a continuation-in-part application of application Ser. No. 806,407 filed June 14, 1977, now U.S. Pat. No. 4,148,436, entitled "SOLAR AUGMENTED HEAT PUMP SYSTEM WITH AUTOMATIC STAGING RECIPROCATING COMPRESSOR" and assigned to the same assignee which application is a continuation-in-part application of application Ser. No. 782,675 filed Mar. 30, 1977, entitled "AIR SOURCE HEAT PUMP WITH MULTIPLE SLIDE ROTARY SCREW COMPRESSOR/EXPANDER," now U.S. Pat. No. 4,086,072 issuing Apr. 25, 1978, which in turn is a continuation-in-part application of application Ser. No. 653,568 filed Jan. 29, 1976, entitled "HEAT PUMP SYSTEM WITH HIGH EFFICIENCY REVERSIBLE HELICAL SCREW ROTARY COMPRESSOR", now U.S. Pat. No. 4,058,988, issuing Nov. 22, 1977, both assigned to the common assignee.

FIELD OF THE INVENTION

This invention relates to air source heat pumps, and more particularly, to improved high efficiency heat pump systems employing a multi-cylinder reciprocating compressor.

BACKGROUND OF THE INVENTION

Reciprocating compressors are universally employed in heat pump systems for residential building structures and the like and operate in conjunction with outdoor and indoor coils which coils trade functions; the outdoor coil constituting an air source evaporator while under heating mode, for instance. While under cooling mode, the indoor coil becomes the system evaporator and the outdoor coil becomes the air source condenser.

Depending upon the geographical location of the residence employing the heat pump, the loads during summer and winter operation vary. For instance, when in use in the northeastern states, the heat pump system is subjected to high heating loads in comparison to cooling loads, while in the southern states such as Florida, the heat pump system experiences heavy cooling loads during summer operation and light heating loads during the winter months.

Further, to effect low cost construction, normally the compressor units, which may be of the hermetic design, employ single phase electric motors for driving the compressor. Where such compressors are under load during starting, the current loads on the motor are significantly large such that in most cases, the motor must be oversized for starting since the load is higher than normal operation high heating or cooling load conditions, after start up. Further, reciprocating compressors conventionally of the multi-cylinder type have the suction gas simply supplied to all cylinders in parallel under single stage compressor mode with little though to system efficiency both in terms of electrical loads imposed by starting the electric motor under load and loads imposed by refrigeration circuit operation conditions.

Attempts have been made to improve system efficiency by operating the reciprocating multi-cylinder compressor in double stage operation, depending upon system conditions, this being the subject matter of the referred copending application. Further, it has been determined that system efficiency may be improved by incorporating a subcooler between the coils, which functions to subcool the liquid refrigerant downstream of that coil constituting the condenser prior to feeding the liquid refrigerant to the coil acting as the evaporator of the system for expansion within that evaporator coil. In such subcoolers, which also forms a part of the subject matter of the referred to copending application, a portion of the high pressure liquid refrigerant is bled from the system and vaporized in the presence of the total liquid refrigerant in a suitable subcooler heat exchanger to further reduce the temperature of that portion of the refrigerant delivered to the coil functioning as the evaporator under the particular mode, whether it be heating or cooling. The vapor generated in the subcooler, being at a pressure well above that of the vapor pressure from the coil or coils acting as the system evaporator and directed to the suction side of the reciprocating compressor, is permitted to return to the reciprocating compressor crank case for the multiple cylinders to maintain load reversal on the wrist pins of the reciprocating compressor piston and connecting rod assemblies of the multicylinder reciprocating compressor of the referred to copending application.

It is, therefore, a primary object of the present invention to provide an improved, simplified automatic tri-level multiple cylinder reciprocating compressor heat pump system wherein compressor operation is matched to system heating and cooling loads regardless of the unequal load condition with three levels of compressor operation being readily achieved and automatically effected.

It is a further object of the present invention to provide a simplified, automatic tri-level multiple cylinder reciprocating compressor heat pump system, in which, dependent upon indoor and outdoor conditions, the compressor three level operation may be effected by cutting out or adding compressor cylinders to the compressor compression process and/or shifting the compressor drive motor between low and high speed operation.

It is a further object of the present invention to provide an improved tri-level, multiple cylinder reciprocating compressor heat pump system which includes a subcooler for subcooling liquid refrigerant being fed to the heat pump system coil acting as the system evaporator, and wherein the vapor returned from the subcooler is passed over the motor windings in a hermetic reciprocating compressor package open to the compressor crank case and delivered to the low side of a given cylinder.

It is a further object of the present invention to provide an improved air source heat pump three-step tri-level multiple cylinder reciprocating compressor heat pump system which permits thermal energy to be picked up by an outside air coil and supplied selectively to either one or all of an inside air coil, inside hydronic coil, and storage coil, depending upon system needs.

It is a further object of the present invention to provide a simplified tri-level, multiple cylinder, reciprocating compressor heat pump system in which, under mild ambient conditions, thermal energy may be removed from the room being conditioned and stored by way of a storage coil during the day and may be supplied to the same room as usable heat from the storage coil during the night.

It is a further object of the present invention to provide an improved, simplified tri-level multiple cylinder reciprocating compressor heat pump system, wherein heat may be removed from the room being conditioned during high ambient temperature conditions during the day and stored by way of the storage coil within the system for subsequent discharge by way of the outside air coil at night at lower ambient temperature for improved system thermal efficiency.

SUMMARY OF THE INVENTION

The present invention is principally directed to an improved air source heat pump system of the type having a first heat exchanger which forms an indoor coil, a second heat exchanger forming an outdoor coil, and a third intermediate pressure evaporator coil which may be a solar energy fed storage coil as an example. The invention involves a multi-cylinder reciprocating compressor and conduit means carrying refrigerant connects the coils and the compressor in a closed fluid circuit. Preferably, the conduit means includes a reversing valve for connecting the indoor and outdoor coils in a closed series loop with the reversing valve functioning to cause the indoor and outdoor coils to operate alternately as low pressure evaporator or high pressure system condenser. Further, means are provided for selectively supplying refrigerant to the intermediate pressure evaporator coil for evaporation therein and the improvement resides in the multi-cylinder reciprocating compressor constituting a hermetic compressor unit including a hermetic casing, at least three cylinders within the casing, pistons within the cylinders, a motor within the casing and operatively coupled to the pistons for driving the pistons of the reciprocating compressor. The conduit means includes first conduit means for supplying low pressure suction return vapor from the system evaporator to the hermetic casing for flow over the motor to cool the motor and thence to a first cylinder for recompression. Second conduit means are further provided for supplying intermediate pressure refrigerant vapor from the intermediate pressure evaporator coil to the first cylinder and includes means for cutting off the first cylinder to the suction return refrigerant vapor from the system evaporator when the intermediate pressure refrigerant vapor is being supplied to the first cylinder. Conduit means are provided for selectively directing low pressure suction return refrigerant vapor from the system evaporator to at least said third cylinder such that the compressor may be operated at partial load conditions with refrigerant vapor compressed at low pressure by said first and second cylinders and under increased load conditions with the low pressure suction return refrigerant vapor compressed by the second and third cylinders and the intermediate pressure refrigerant vapor from the intermediate pressure evaporator coil compressed by the first cylinder such that the third cylinder functions in a capacity control mode.

Preferably, the compressor drive motor comprises a two speed motor and the system comprises control means for operating the motor at low speed with the first and second cylinders connected to the system evaporator under low system load conditions at low speed with the first, second and third cylinders connected to the system evaporator under intermediate load conditions and with the motor operating at high speed and the second and third cylinders connected to the system evaporator and the first cylinder connected to an intermediate pressure evaporator coil to thereby provide three step compressor loading.

Preferably, the refrigerant vapor from either the low pressure suction return from the evaporator or the intermediate pressure vapor returning from the intermediate pressure evaporator is directed over the motor windings to the crank case of the multiple cylinder reciprocating compressor to assure wrist pin load reversal for all of the compressor cylinders and to the first cylinder for recompression. The conduit means may include a suction line leading from the reversing valve to at least one of the cylinders, a discharge line leading from the discharge side of all of the compressor cylinders to the reversing valve for supplying compressed refrigerant vapor to the system condenser regardless of system mode, and with the system further including a shorting line connecting the discharge line to the suction line with the shorting line carrying a solenoid operated control valve for selectively opening the shorting line to permit the compressor drive motor to be energized with all compressor cylinders fully unloaded.

Preferably, the intermediate pressure evaporator coil comprises a subcooler and the means for selectively cutting off the first cylinder comprises a check valve within the means leading from the reversing valve to the hermetic casing such that the evaporator suction return refrigerant vapor flows to the hermetic casing for cooling of the motor and recompression by the first cylinder only in the absence of subcooler operation.

A storage coil may be provided in heat transfer relation with a thermal energy storage media and the conduit means may include additional conduit means for selectively connecting the storage coil in parallel with the outside air coil for supplying heat to the refrigerant simultaneously with that supplied by the outside air coil under heat pump system heating mode or for removing heat from the system either simultaneously with the outside air coil or exclusive of the outside air coil when the heat pump system is operating under cooling mode. Further, the invention is directed to a hermetic multi-cylinder reciprocating compressor unit to achieve this purpose and, preferably, comprises four cylinders within two cylinder heads. The first and second cylinders are located within the first cylinder head and the third and fourth cylinders are located within the second cylinder head. Manifold means for the cylinder heads define separate inlets for the first and second cylinders and a common outlet for those cylinders and a common inlet and a common outlet for said third and fourth cylinders within the second cylinder head. A first discharge line leads from the common outlet for the first and second cylinders and a second discharge line leads from the common outlet of the third and fourth cylinders, and a common discharge manifold connects to the first and second discharge lines. A check valve within one of the lines, such as the discharge line from the outlet of the first and second cylinders, permits compressor discharge flow from cylinders 1 and 2 through the common discharge manifold but prevents reverse flow. A heat rejector storage line connects to the common outlet for cylinders 1 and 2 such that the discharge from cylinders 1 and 2 may be supplied to a low pressure condenser while the compressor discharge from cylinders 3 and 4 may be directed to the coil functioning as the system high pressure condenser. Further, under such arrangement, the first cylinder is of less displacement than the second, third and fourth cylinders, the second cylinder is of a displacement larger than the first but smaller than the third and fourth cylinders combined, such that the third and fourth cylinders provide capacity control and the first cylinder functions to compress the intermediate pressure evaporator return vapor to a common discharge pressure with that of said second cylinder. The displacement of the cylinders may be achieved by providing cylinders and pistons of given diameter such that the second cylinder has a given diameter, the first cylinder has a diameter smaller than that of the second cylinder, and the third and fourth cylinders, each have a diameter equal to that of the second cylinder with the pistons having equal strokes.

DESCRIPTION OF THE PREFERRED EMBODIMENT

Figure 1:
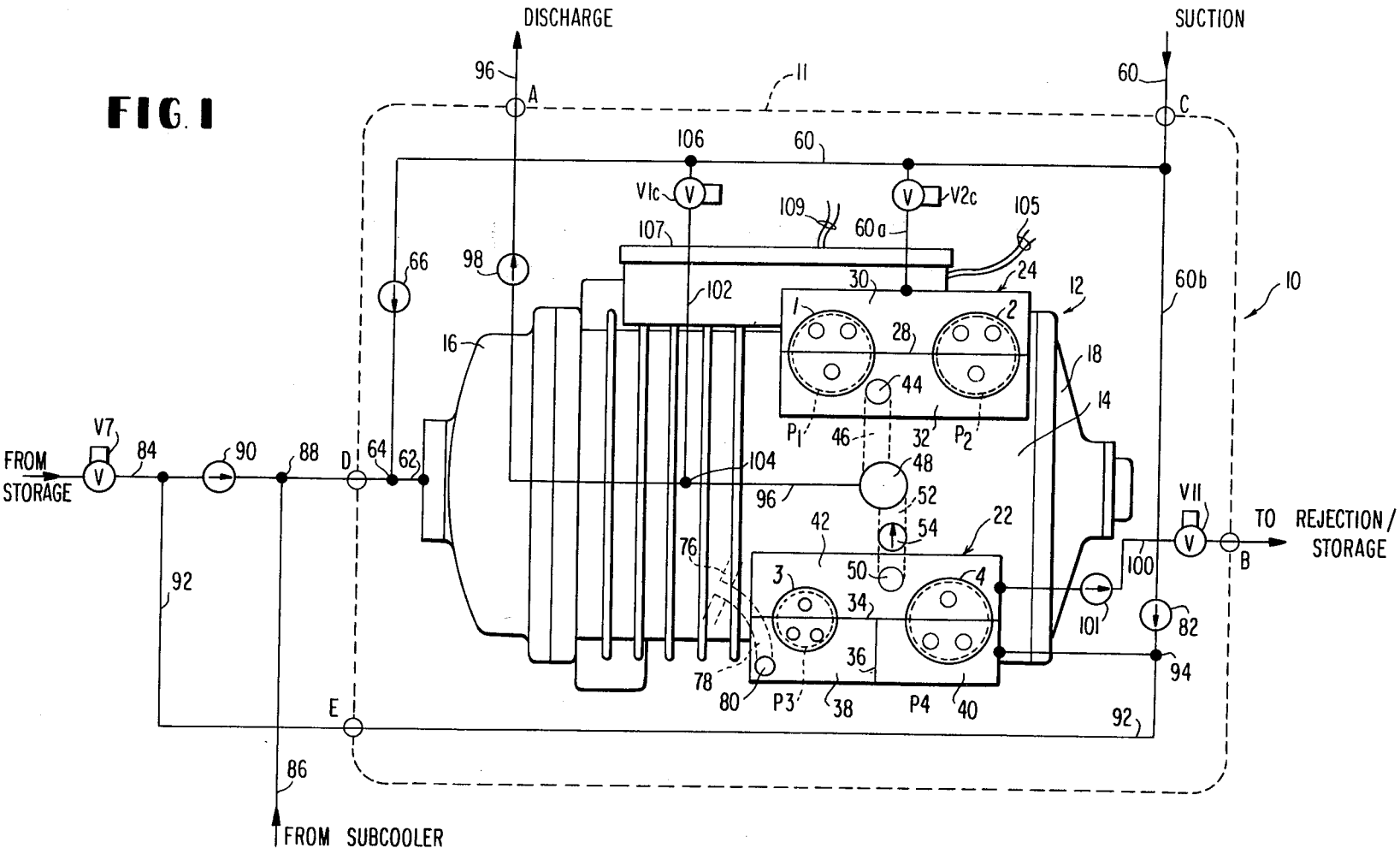
FIG. 1 is a partially schematic view of a modified package multiple cylinder, two speed reciprocating compressor to permit three level compressor operation under both heating and cooling system modes in an air source heat pump system.
Figure 2:
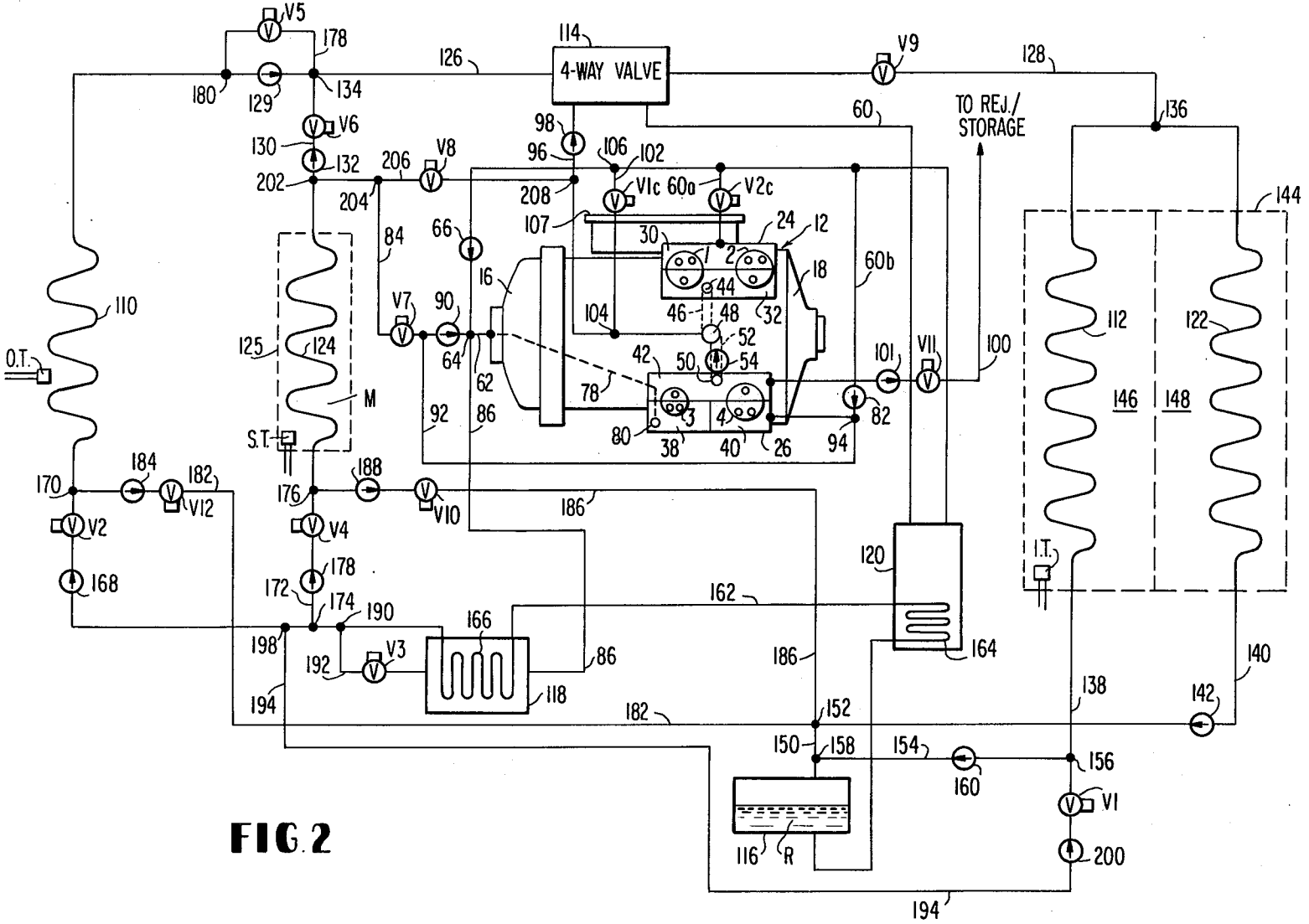
FIG. 2 is a schematic diagram of the improved trilevel, multiple cylinder reciprocating compressor heat pump system of the present invention in a preferred embodiment.

Referring to FIGS. 1 and 2, there is illustrated a compressor package 10 which is shown schematically as an outer housing 11 and purposesly shown in dotted lines as indicative only of the fact that the hermetic compressor unit indicated generally at 12 and interior of the housing constitute a portion of the compressor package 10 along with a plurality of lines, couplings and various control elements. The hermetic compressor unit 12 constitutes a compressor casing 14 having sealed end caps or end bells 16 and 18 at respective ends which are sealably, fixedly coupled to the casing 14 by way of cooperating flanges. The hermetic unit 12 is formed principally of a hermetic, single phase electric motor indicated generally at 20 on the left side of the unit and the reciprocating compressor on the right hand side, and indicated generally at 22. The compressor 22 constitutes in the illustrated embodiment four cylinders 1, 2, 3 and 4, although the invention has application to a multi-cylinder reciprocating compressor of more or fewer than four cylinders; three cylinders for instance.

Cylinders 1, 2 and 4 are shown as being of the same diameter, and larger than cylinder 3. Cylinder 3 may have 1/12 to $\frac{1}{4}$ the total compressor displacement. As will be appreciated hereinafter, cylinders 1 and 2 function as capacity control cylinders for the compressor unit for the air source heat pump system with which it is preferably employed, cylinder 3 functioning as the cylinder in which subcooler return, intermediate pressure refrigerant vapor is compressed by the compressor for either common discharge or selectively directed to a rejection/storage unit. In this respect, the pistons, which are sized to the cylinders, reciprocate with the same stroke and cylinder 3 thus has a different displacement from those of cylinders 1, 2 and 4 which have equal displacement. The cylinders and pistons could be identically sized. Further, capacity could be varied by providing shorter or longer strokes for selected pistons, as at $P_1$, $P_2$, $P_3$ and $P_4$, FIG. 1.

Figure 3:
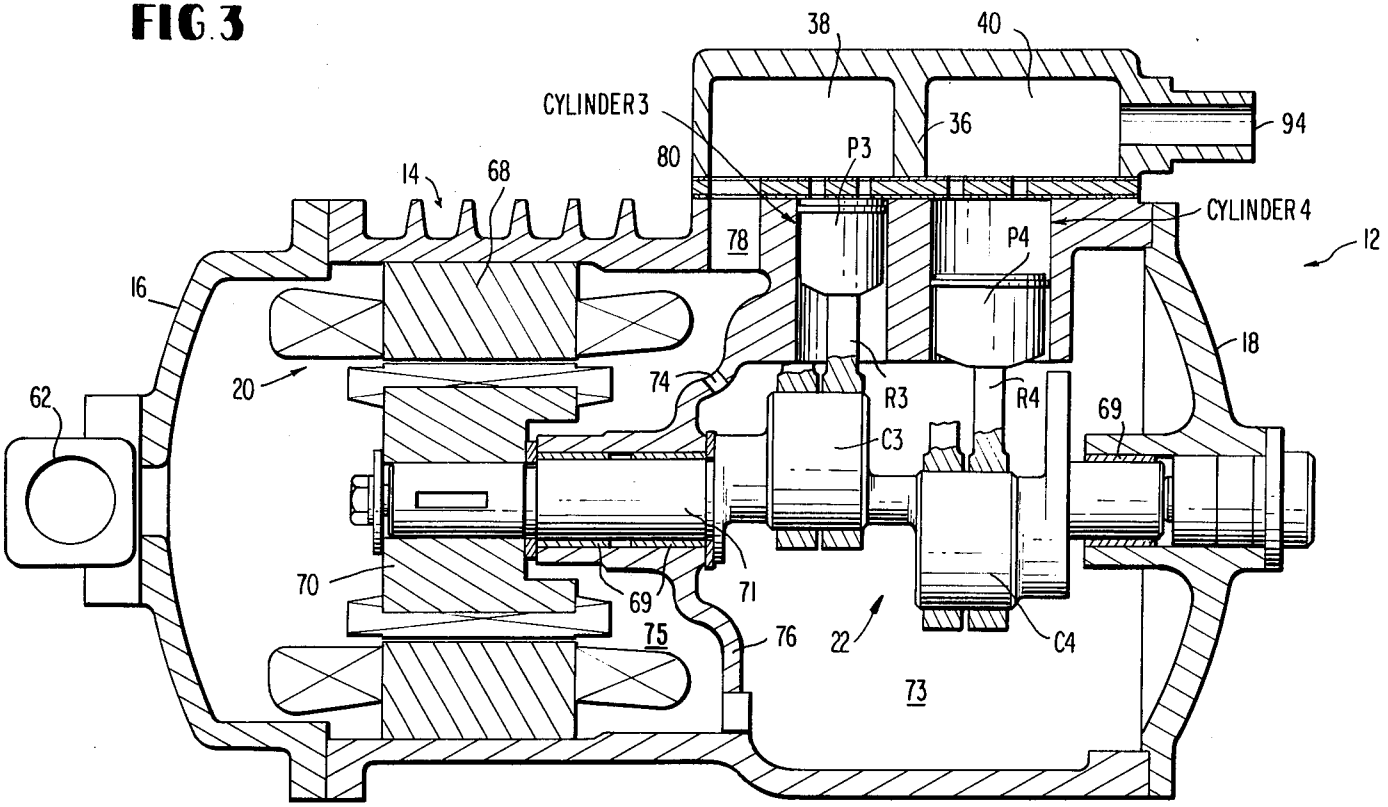
FIG. 3 is a sectional view of the hermetic compressor of FIG. 1 showing the flow of subcooler return vapor over the motor for cooling, and pressurization of the compressor crank case.

By reference to FIG. 3, it may be appreciated that the compressor casing 14 houses the stator 68 which is fixed at one end of the housing and which concentrically surrounds the rotor 70 of the single phase hermetic drive motor 20, the rotor being fixedly mounted to a shaft 71 and supported by way of bearings 69 within opposed end bells, the rotor 70 thus being mounted for rotation about its axis. Conventionally, the cylinders are connected by means of their connecting rods to the shaft 71 such that the motor directly drives the pistons. In that regard, the sectional view shows cylinders 3 and 4, the pistons $P_3$ and $P_4$ within respective cylinders and connected to the shaft by means of connecting rods $R_3$, $R_4$ and crank arms $C_3$, $C_4$, respectively. The partition 76 defines with the hermetic casing 14 and the end bell 18 to the right, the cylinders and the cylinder heads 24, 26, a crank case 73 which is pressurized by the return vapor passing over the rotor 70 and stator 68, the crank case 73 being open to the portion of the hermetic compressor casing 14 housing the stator 68 and rotor 70 by way of passage 74 within the transverse partition or wall 76. Further, as may be appreciated by reference to FIG. 1, by way of tube or conduit 78, the vapor normally returned from the subcooler after it passes over the motor rotor 70 and stator 68 and cools the windings of the single phase two speed motor, enters the low pressure, low side or inlet 38 of cylinder head 26 for compression by the smaller displacement cylinder, and in this case, smaller diameter cylinder 3. At the same time, the crank case 73 is pressurized at a pressure which is normally in excess of the suction pressures being applied to the faces of the pistons within respective cylinders, with the exception of cylinder 3.

In this case, the compressor is provided with cylinders 1 and 2 within cylinder head 24 and cylinders 3 and 4 within cylinder head 26. The cylinder head 24 includes manifold means such as 28 to divide the cylinder head 24 into a low pressure side, low side or inlet 30 and a high pressure side, high side or outlet 32. For compressor cylinders 3 and 4, a manifold 34 divides the low pressure or low side of the compressor cylinder head 26 from that of the high pressure or high side, and in addition, the cylinder head 26 incorporates additional manifold means as at 36, whereby the low pressure sides of both cylinders 3 and 4 are cut off from each other. In that regard, the low pressure side, low side or inlet to cylinder 3 is shown at 38, the low pressure, low side or inlet for cylinder 4 is shown at 40, and there is a common high pressure, high side or discharge 42 for both cylinders 3 and 4. The compressor, the cylinders, the manifolding and the heads are shown schematically as well as the outlet or discharge connections for the compressor cylinder heads. In that regard, a discharge port 44 for the common discharge 32 for cylinders 1 and 2 is connected by way of conduit or passage 46 shown in dotted line to a compressor discharge manifold 48 to which is also connected the common discharge or high side 42 of cylinders 3 and 4 through a discharge or outlet port 50. Port 50 through conduit indicated by dotted lines 52 opens to the common discharge manifold 48. Incorporated within conduit or passage 52, is a check valve 54 for permitting flow from the discharge or high side of cylinders 3 and 4, that is, from outlet 42 for cylinders 3 and 4 to the common discharge manifold 48 but prevents reverse flow.

With respect to the above portion of the description of the compressor 14, its make-up and manifolding is somewhat similar to that of the copending application noted above. However, there are a substantial number of differences between the compressor of that copending application and the instant invention.

First of all, with respect to the hermetic unit 12, the normal return to compressor suction from the various coils functioning as evaporators within the system is via a first conduit 60 at suction return C of the compressor housing 10. Line 60 connects to the inlet or low side of compressor head 24, through line **60*a* common to cylinders 1 and 2, line 60*a*** including a solenoid operated shut-off valve V2*c*. This permits the refrigerant vapor being returned selectively by energization of the solenoid operated valve V2*c* to two of the cylinders 1 and 2 of the compressor 14. Further, line 60 connects to end bell 16 of the hermetic compressor unit 12 via conduit 62 from connection point 64 downstream of check valve 66. Line **60*b* defines another flow path for suction return C to cylinder 4**.

One aspect of the present invention is to employ the refrigerant vapor returning to the suction side of the compressor as the means for cooling the hermetic motor by flowing over the stator 60 and rotor 70 of that unit of the motor 20.

Further, vapor within the chamber housing the rotor and stator enters the crank case indicated generally at 73 via passage 74 within wall 76 which divides a motor section from the compressor section of the hermetic compressor unit 12.

Further, as shown in dotted line at 78, cylinder 3 is fed with the same refrigerant vapor as is directed to the crank case 73 vapor passing through inlet port 80 which opens up into the inlet or low side 38 to cylinder 3 of cylinder head 26 via tube 78 from motor chamber 75 downstream of motor 20. The refrigerant vapor is compressed by cylinder 3 for discharge to the common discharge or high side 42 of that head and for normal delivery to the common discharge manifold 48 of the compressor.

Further, by way of line **60*b*, refrigerant vapor can pass through check valve 82, to the inlet or low side 40 of cylinder 4 for compression by that cylinder. The check valve 66, within line 60 and 82, within line 60*b* prevent refrigerant vapor flow towards cylinders 1 and 2 should refrigerant vapor be returned to the compressor for feeding cylinders 3 and 4 at pressure levels in excess of that available to the multiple cylinders of the compressor through suction line 60**.

In that respect, it is contemplated that in addition to normal suction line supply to cylinders 3 and 4, refrigerant vapor may be made available to selected cylinders of the compressor as at 3 and 4 from a storage source, through line 84 and/or from a system subcooler or other intermediate pressure evaporator, through line 86 opening to line 84 at junction 88. In that regard, the line 84 from storage includes a solenoid operated control or shut-off valve V7, within line 84 upstream of check valve 90, line 84 being coupled to line 62 at point 64 and entering compressor housing at point D, line 84 permitting refrigerant flow simultaneously to cylinder 3 through line 62 and also to cylinder 4 through line 92 and intersecting line **60*b* at point 94. Line 86 from the subcooler intersects lines 84 at point 88 upstream of the connection of line 84 to lines 62 and 92 such that refrigerant vapor either from storage or from subcooler may flow to cylinders 3 and 4 as desired and permitted by the system, while at the same time the check valve 90 permits the storage evaporator to generate a higher pressure level refrigerant vapor than the subcooler evaporator, permitting both flows in a direction toward cylinders 3 and 4 via lines 62 and 92, but prevents flow from the subcooler to the storage due to the presence of that check valve 90. At the same time, since normally the refrigerant vapor from storage or from the subcooler is at a higher pressure than that returning to the compressor unit via suction line 60, the check valves 66 and 82 prevent the storage or subcooler refrigerant vapor from passing towards suction line 60 and cylinders 1 and 2 due to the presence of those check valves 66 and 82 within lines 60 and 60*b***, respectively.

Since line 62 directs refrigerant vapor to the crank case via passage 74 within wall 76, it is obvious that at all times the pressure beneath the pistons in the crank case is no lower than the suction pressure at the top of the pistons.

As stated previously, by operation of the solenoid operated valve V2*c* within line **60*a*, both cylinders 1 and 2 of cylinder head 24** may be selectively cut in and cut out of the compression process. In that respect and throughout the application, the solenoid operated valves are intended to be shut-off valves and to be normally closed in the de-energized condition. Thus, with solenoid valve V2*c* de-energized, cylinders 1 and 2 are cut out and suction return via suction line 60 is directed only through lines 60 and 62 to cylinder 3 and through line **60*b* to cylinder 4. Further, the discharge manifold 48 permits the compressor to discharge refrigerant vapor fully compressed in a single stage compression process via discharge line 96, the discharge line 96 including a check valve 98 and discharging refrigerant vapor from the machine at discharge point A, FIG. 1**.

In order to provide the capability of the rejection of heat in cases where there is more heat being generated than may be used, for instance, in either supplying one or more indoor coils functioning as condensers or heat supply coils for the space or room being conditioned and for supplying heat to a storage coil within the system, the common discharge from cylinders 3 and 4 may be directed to a heat rejection coil external of the compressor housing environment through line 100 which exits from the compressor housing 10 at point B and is connected directly to the common compressor discharge or outlet side 42 of the compressor cylinder head 26.

Further, the discharge line 96 for the compressor is provided with a bypass or shorting line as at 102 between point 104 of line 96 and point 106 of suction line 60, line 102 including a solenoid operated control valve V1*c* which selectively connects, when energized, the suction and discharge sides of the compressor cylinders together so as to completely unload the machine during start up. The solenoid control valve V1*c* being a normally closed valve causes, when energized, the connection of the high side of the compressor directly to the low side, preventing pressure build up and allowing totally unloaded start conditions. This permits the hermetic motor 20 to be of relatively small size and improving the efficiency of the system.

An explanation of the hermetic compressor unit and the control elements and fluid connections of FIG. 1 may be best appreciated by reference to FIGS. 2 through **2*e* which illustrate a preferred embodiment of the tri-level multiple cylinder reciprocating compressor heat pump system of the present invention under various stages of operation. Like elements are given like numerical designations, and FIG. 2 is essentially a complete multiple coil heat pump system utilizing the hermetic compressor package 10 of FIG. 1**.

It should be apparent that while the system of FIG. 2 makes use of a storage coil and an inside hydronic coil in addition to conventional outside air and inside air coils, the system of the present invention may advantageously employ only an outside air coil and an inside air coil, preferably with the subcooler for three level multiple cylinder reciprocating compression operation for improved system efficiency.

The electric motor 20 may be of the single phase two speed type wherein conventionally suitable controls such as control unit 107 acts to change the number of poles as from four poles to two poles, or eight poles to four poles, etc., to double the speed of rotation of rotor 70 by applied electrical control signals through leads 109. Current is delivered to the motor via the control unit 107 by way of leads 105 leading to an electrical source (not shown). Control unit 107 may be connected to all solenoid operated control valves of the system, the reversing or four way valve 114, FIG. 2, may be programmed for system operation as hereinafter described and receive inputs from outdoor thermostat OT adjacent outside air coil 110 sensing the temperature of the air passing over that coil, a two step or two position indoor or room thermostat IT, within space 146 being conditioned, and storage thermostat ST sensing the temperature of storage media M, FIG. 2.

In FIG. 2, in addition to the compressor unit 12, the main components of the heat pump system in a preferred embodiment include conventionally an outside air coil 110, an inside air coil 112, a four way valve 114, a receiver 116, a subcooler 118 and an accumulator 120, these being essentially minimal components for a heat pump system incorporating the present invention. Additionally, however, there is provided an inside hydronic coil 122 which is in parallel with the inside air coil 112 and which conventionally supplies heat to a circulating liquid such as water to effect, for instance, soft heating of limited areas of a room or space 148 to be conditioned such as those adjacent to an outside wall of an enclosure 144, while the inside air coil 122 permits heat delivery and under heating cycle or heating mode operation to space 146 being conditioned, or extracts heat therefrom when the inside air coil 112 acts as an evaporator during reverse flow cooling mode operation. Further, the system employs a storage coil 124 whose function is to selectively store thermal energy or remove thermal energy from a storage media M within a storage container 125, during either cooling or heating mode of the heat pump system, depending upon outdoor ambient conditions and indoor temperature conditions of the space being conditioned, or when the system has no demands from enclosure 144.

The solenoid operated four way valve 114 is of conventional construction and simply reverses suction line 60 and discharge line 96 with respect to lines 126 and 128, line 126 being connected to the outside air coil 110 through check valve 129 and to the storage coil through line 130, which line also includes a check valve 132. The check valves 129 and 132 provide, respectively, for refrigerant flow through outside air coil 110 and storage coil 124 in the direction of their common juncture point 134 but not reverse flow. Line 128 is connected commonly at point 136 to the inside air coil 112 and the inside hydronic coil 122, through paired lines 138 and 140, respectively. A check valve 142 is provided within line 140 to permit the inside hydronic coil 122 to function as a condenser but prevent its operation as an evaporator by reverse refrigerant flow through that coil. No such check valve is provided for the inside air coil 112 which may function alternately as a condenser and evaporator coil depending upon the necessity to heat or cool the space 146 being conditioned. In that respect, the total space to be conditioned within enclosure 144 is divided into an interior space 146 subjected to heating or cooling by the heat transfer via the inside air coil 112 and a second space 148 which is subjected, only to heating by controlled flow of refrigerant through the inside hydronic coil 122 when the heat pump system is operating under heating mode. The space 148 may constitute a room specifically being heated or hot water heaters under retrofit application of the present invention to an existing hot water heating system.

The refrigerant R within line 140 is directed to receiver 116 through line 150 which intersects line 140 at point 152. Further, refrigerant within line 138 and the inside air coil 112 may also be returned to the receiver through line 154 which intersects line 138 at point 156 and which is connected to line 150 at point 158, permitting commonly, refrigerant flow to the receiver from both coils 112 and 122. Line 154 includes a check valve 160 which permits flow of refrigerant towards the receiver from the inside air coil 112 but not in the reverse direction from the receiver 116. The refrigerant R, which is provided to the system, accumulates as a liquid within the receiver 116 and is directed from the receiver through liquid refrigerant supply line 162 to the accumulator 120 where that liquid refrigerant is subcooled to some extent, prior to reaching subcooler 118, by way of accumulator coil 164. Line 162 extends to the subcooler and bears the subcooler coil 166 such that the liquid refrigerant can be subcooled both at the accumulator and at the subcooler, prior to its being directed selectively to either the storage coil 124 or the outside air coil 110, when the heat pump system is operating under heating mode, or to indoor air coil 146 during cooling mode.

In that regard, line 162 includes a further check valve 168 spaced from its connection to the outside air coil at point 170. Line 162 carries solenoid operated control valve V2 such that line 162 can be shut off as desired, preventing liquid refrigerant R from the receiver 116 to reach the outside air coil 110 except upon energization of the solenoid operated control valve V2. Similarly, line 172 connects to line 162 at point 174 and to the storage coil 124 at point 176, the line 172 bearing a check valve 178 and a solenoid operated control valve V4. Thus, refrigerant flow from the receiver through the subcooler can flow only to the storage coil upon energization of the solenoid operated control valve V4 and in a direction to permit the storage coil to act as an evaporator; reverse flow being prevented by the check valve 178. The outside air coil 110, the storage coil 124 and the inside air coil 122 are provided with expansion devices such as capillary tubes, thermal expansion valves or the like (not shown), to effect expansion and vaporization of the liquid refrigerant within these coils selectively and to thereby permit those coils to operate as evaporators under given system conditions. When the outside air coil 110 and the storage coil 124 are functioning as evaporators, the vaporized refrigerant after picking up heat is returned to the compressor through check valves 129 and 132 respectively and four way valve 114. In this case, a solenoid operated control valve V6 within line 130 is energized as well as solenoid operated control valve V4 within line 172 and solenoid operated control valve V2 for outside air coil 110. A bypass line 178 bypasses the check valve 129, line 178 being connected to line 126 at points 134 and 180. Line 178 bears solenoid operated control valve V5, permitting by energization of that solenoid operated control valve V5, compressed refrigerant vapor flow from the four way valve 114 through line 126 to the outside air coil 110. In that situation, the outside air coil acts as a condenser. A return line 182 is provided with a solenoid operated control valve V12, thus with coil 110 as a high pressure condenser, condensed refrigerant flows through line 182 and check valve 184 to the receiver, line 182 intersecting line 150 at point 152. This point is also a common connection for line 186 which bears check valve 188 and a solenoid operated control valve V10 and is connected to the storage coil 124 at point 176 such that under certain conditions where the storage coil is acting as a condenser, condensed refrigerant can flow from the storage coil 124, after being received from the compressor, through check valve 188 and line 186 to the receiver via line 150.

The subcooler is conventional. The refrigerant line 162 is tapped at 190 via line 192 leading to the subcooler and bearing a solenoid operated control valve V3, such that upon energization of the control valve V3, liquid refrigerant enters the subcooler and expands to subcool the liquid refrigerant within coil 166 upstream of tap point 190. The vaporized refrigerant at an intermediate pressure (between compressor suction and discharge) is directed to connection point 64 and line 62, via line 86 which constitutes the subcooler return, this refrigerant vapor being compressed by cylinder 3 since the vapor not only passes over the motor stator and rotor to cool the same, but also reaches the crank case to pressurize the crank case, entering the inlet or low side 38 of compressor head 26 prior to recompression by cylinder 3.

Further, when the inside air coil 112 is functioning as a low pressure evaporator coil, it receives refrigerant from liquid refrigerant line 162, downstream of the subcooler 118, through a conduit 194 which connects to line 162 at point 198, the intersects line 138 at point 156. The line 194 bears a check valve 200 which permits liquid refrigerant flow from the liquid refrigerant line 162, downstream of the subcooler, to the inside air coil 112 but prevents reverse flow; the flow through this line 194 being further controlled by solenoid operated control valve V1 located between the check valve 200 and connection point 156.

Further, while the solenoid operated control valves V2 and V6 permit the outside air coil 110 and the storage coil 124 to return refrigerant vapor from these coils selectively to the compressor, the present system permits heating requirements to be achieved by feeding refrigerant from a high evaporating pressure rather than a low evaporating pressure such that depending upon the evaporating pressure within the outside air coil 110 or the storage coil 124, the flow can be controlled in a suitable manner. For instance, between the storage coil 124 and check valve 132, at point 202 within line 130, there is connected one end of line 84 which bears solenoid operated control valve V7, this line 84 permitting by energization of the solenoid operated control valve V7, refrigerant vapor flow to the inlet or low pressure side 38 of head 26 for compression of that vapor by cylinder 3, and by way of line 92 to the low pressure or low side 40 of the head 26 for compression by cylinder 4.

Additionally, line 206 is connected at an end to line 84, at 204, and thus storage coil 124, between the storage coil 124 and the solenoid operated control valve V7, and at its opposite end, at point 208, to compressor discharge line 96 such that by energization of the solenoid operated control valve V8 within line 206, compressed refrigerant vapor discharged from the compressor may be directed to the storage coil 124 to operate the storage coil as a condenser and to store heat emanating from another part of the system such as the inside air coil 112 or outside air coil 110 which would be acting as evaporator coils.

As in FIG. 1, the hermetic compressor unit 12 is further provided with a line 100 leading from the common high side 42 for cylinders 3 and 4 to permit, in a selective manner under the control of solenoid operated control valve V11 and by way of a check valve 101, the high pressure compressed refrigerant vapor to be directed to a heat exchange coil functioning to reject heat or to store heat in addition to storage coil 124. The storage coil 124 is immersed within the mass of heat storage liquid or the like media M which readily receives and gives up heat to that coil 124 depending upon system demands.

Reference will now be made to typical system operating conditions illustrating the utility of the present invention as applied to a representative heat pump system. Reference to FIG. *2a* shows the basic components of the system under heat pump heating mode with relatively mild outdoor ambient.

Referring next to FIG. *2a*, the heat pump system of the present invention is considered as having the outside air coil 110, the inside air coil 112, and the inside hydronic coil 122, as the only existing coils within the system with the system lacking storage coil 124 and its controls and attendant equipment.

In fact, while the system is shown as including an inside hydronic coil 122 for independently conditioning space 148, such coil could be eliminated, and the invention would have equal application to a two-coil heat pump system consisting of only outside air coil 110 and inside air coil 112. In such case, the receiver 116 could also be eliminated, with the inside air coil 112 feeding directly to subcooler 118 by connection of line 162 directly to line 138 at connection point 156. Under the realization that the system could be simplified to that degree, a typical system under operation during three step heating starting with mild ambient conditions will now be discussed.

As may be further appreciated, one aspect of the present invention resides in the start up of the two speed motor, of course at low speed and under conditions in which the compressor is totally unloaded. This is achieved by energization of solenoid operated control valve V1*c* as shown in dash-dot line fashion, which opens line 102 between the suction return line 60 and the compressor discharge line 96, such that the suction and discharge sides of all four cylinders 1, 2, 3 and 4 are connected together with resultant driving of the cylinders under no load, non-gas compression conditions.

After the unload-start sequence is completed and solenoid operated control valve V1*c* de-energizes, and with the four way valve 114 in the heating mode as shown, discharge line 96 is connected to line 128 leading to the indoor air coil 112 and the indoor hydronic coil 122 and the line 126 from the outside air coil 110, is feeding and is connected to the suction return line 60 including accumulator 120, compressed refrigerant discharging from the compressor, via discharge or outlet manifold 48, is directed to the inside air coil 112 and the inside hydronic coil 122. Only solenoid operated control valves V2 and V9 are energized, while solenoid operated control valves V1*c*, V2*c*, V3, V4, V5, V6, V7, V8, V10, V11, V12 are not energized. De-energization of the solenoid operated control valve V1*c* terminates the mechanical short between the suction and discharge sides of the compressor by shutting off the connection between discharge line 96 and suction line 60. Energization of solenoid operated control valve V2 permits liquid refrigerant flow from the receiver 116 by way of accumulator coil 164 and subcooler coil 166 to the outdoor air coil which functions as an evaporator coil under heating mode.

The two speed motor is maintained energized by motor control 107 at low speed operation. The de-energization of solenoid operated control valve V2*c* takes cylinders 1 and 2 off the line by shutting off line 60*a* leading from the suction return line 60 to the low side or inlet 30 for cylinders 1 and 2 of cylinder head 24. Condensed refrigerant flows from the inside air coil 112 and the inside hydronic coil 122 to the receiver 116 and from the receiver through liquid refrigerant supply line 162 to the outside air coil 110 acting as the system evaporator where it is expanded through the use of a suitable expander and returned, after absorbing heat, to the suction return line 60 through line 126 and the four way valve 114. Refrigerant vapor entering cylinder 3 through line 62, passes over the hermetic motor stator 68 and rotor 70 for cooling the same and passing to the low side or inlet 38 of cylinder head 26 via port 80 for compression along with a second portion of the return gas by way of line 60*b* and check valve 82 to the low side or inlet 40 for cylinder 4 of the same cylinder head 26. Thus, only two cylinders 3 and 4 are operating to compress refrigerant under low speed motor operation. The de-energization of valve V3 prevents the subcooler from being fed liquid. The inside hydronic coil and the inside air coil seek a common condenser pressure level, since they are both in parallel. Under some conditions of operation, either coil could back up with a degree of refrigerant liquid and the receiver 116 is necessary for charge balance. Liquid coming out of the receiver 116 passes through the suction accumulator 120 where a limited degree of subcooling takes place, then passes into the subcooler and through subcooler coil 166 and directly to the outside air coil as shown but is not further subcooled at this point since solenoid operated control valve V3 is de-energized, cutting off flow through subcooler return line 86.

If the outdoor thermostat OT defines the second step of heating, appropriately solenoid operated control valve V2*c* is energized, opening the line 60*a* between the suction return line 60 and the common low side or inlet 30 to compressor cylinders 1 and 2 for cylinder head 24, and thus placing cylinders 1 and 2 in compression along with cylinders 3 and 4. At the same time, appropriately, the solenoid operated control valve V3 is energized and is shown in dotted line fashion. Under the second step heating mode, not only is refrigerant vapor flowing to cylinders 1 and 2 for compression, but some liquid refrigerant, bled from line 162, passes to the subcooler, where it is expanded to subcool the liquid refrigerant within subcooler coil 166 of the liquid refrigerant line 162. The bled portion of liquid refrigerant, as vapor, passes at an intermediate pressure above suction but below full compression to point 64, where it enters the hermetic housing through the end bell 16, discharging over the stator 68 and rotor 70 of the two speed motor 20, cooling the same, pressurizing the compressor crank case and finally entering cylinder 3 for compression through port 80 which opens to the inlet or low side 38 of cylinder head 26 leading only to cylinder 3 of that portion of the compressor. Since the subcooler return vapor is at pressure higher than that within the suction return line 60, only the subcooler refrigerant vapor can pass to cylinder 3, the suction return line refrigerant in vapor form being directed to cylinders 1 and 2 through line 60*a* and cylinder 4 through line 60*b*. Check valve 66 within line 60 and check valve 90 within line 84 limits relatively high pressure subcooler return vapor flow to cylinder 3. Under these conditions of operation, the compressor operates at maximum capacity at low speed. High speed operation would not be initiated until the outside air temperature drops further under the setting determined by the outside thermostat OT. When the outside air temperature as sensed by thermostat OT drops to the point whereby home heat loss is starting to approach the capacity of the machine when operating with all four cylinders at low speed, then the outdoor air thermostat OT will initiate a control sequence which would change control operation to one in which the indoor thermostat IT would not allow the compressor to go off.

The indoor thermostat IT, when in its neutral position or off position, would permit operation of the compressor at low speed with only two cylinders operational, that is, cylinders 3 and 4, with solenoid operated control valve V2*c* closed and solenoid operated control valve V3 closed. This constitutes the first stage system operation under low outdoor temperature conditions.

As the indoor temperature continues to drop, solenoid operated control valves V2*c* and V3 are energized simultaneously, adding cylinders 1 and 2 to the compression process with the motor still running at low speed and effecting subcooler operation with liquid refrigerant flow to the subcooler 118 via line 192. This constitutes a second step heating under cold ambient conditions.

Again, if the indoor temperature drops further, appropriately the motor control 107 is energized to change the motor connection to the stator from four pole to two pole and double the speed of the compressor motor 20. Once in high speed mode, it may be further desirable to allow an additional control sequence permitting the solenoid operated control valves V2*c* and V3 to be de-energized once the heating load is overbalanced with four cylinder operation at high speed, eliminating the subcooling process and removing cylinders 1 and 2 from the compression process. Thus, the compressor in high speed mode would cycle between two and four cylinders in operation, and during four cylinder operation the subcooler is cut into the refrigeration circuit. If this mode is selected, then the indoor thermostat IT will have the following control sequence during low ambient operation. The normally off position will allow low speed operation with only cylinders 3 and 4. The first step of heating will cause a shift to high speed, but still unloading. The second step of heating causes all four cylinders in the subcooler to be activated when under high speed mode.

The present invention advantageously offers the acceptable alternative under solid state control of either effecting a speed change for the compressor drive motor or unloading the compressor by taking one or more cylinders out of the compression process.

Figure 2A:
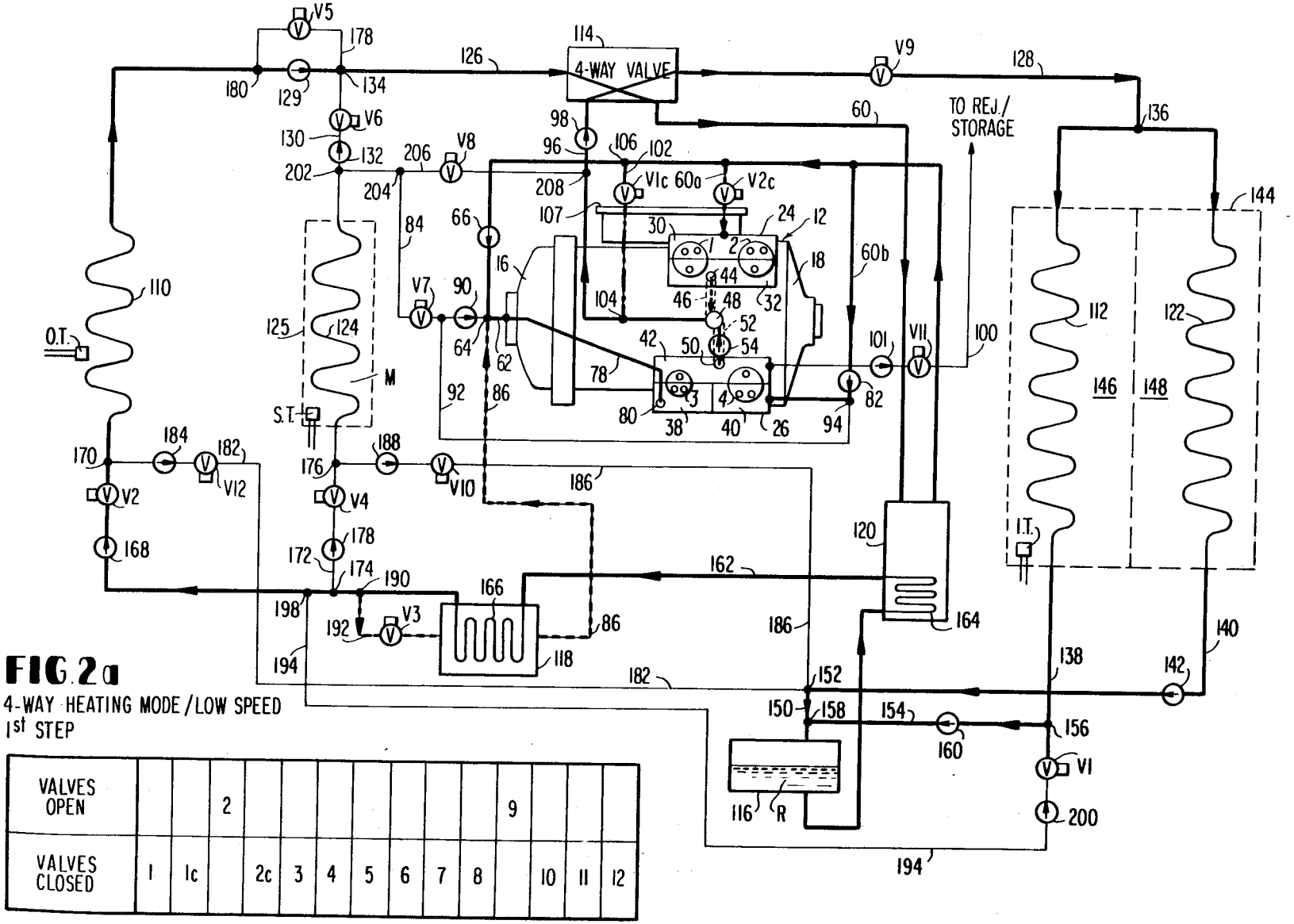
FIG. 2*a* is a schematic diagram of the improved trilevel, multiple cylinder reciprocating compressor heat pump system of FIG. 2 operating under standard heating mode.

By further viewing FIG. 2*a*, it may be appreciated that the basic air source heat pump system involves two condensers in parallel under heating mode, that is, the inside air coil 112 and the inside hydronic coil 122. One is a refrigerant to air condenser and the other is a refrigerant to water condenser (operable only during the heating mode). The purpose of the inside hydronic condenser as shown is to allow a degree of hot water heat in typical retrofit applications or even new applications where the hydronic system is maintained at approximately 100° or 110° F. condensing temperature, thus allowing a degree of comfort during the colder weather that would be unobtainable with direct air systems. The perimeter of the residence may be provided with soft heat, while obviously the air flow will take care of the balance of the requirements. This would prevent cold spots near walls, etc., in the residence or other space being conditioned.

To achieve cooling of the space within enclosure 144 to be conditioned under the system componentry discussed in FIG. 2*a* as being operable within that system, it is necessary only to energize solenoid operated control valve V1*c* to effect unload start up, and thence upon de-energization of solenoid operated control valve V1*c*, energization of solenoid operated control valves V5 and V9 in a basic system, with the four way valve 114 being shifted to cooling mode operation, wherein discharge line 96 connects to line 126 and suction return line 60 connects to line 128 which extends to the inside air coil 112. Under this type operation, with the compressor being driven at low speed or high speed, loaded or unloaded, that is, with all four cylinders 1, 2, 3 and 4 or only cylinders 3 and 4 in the compression process, by energization of solenoid operated control valve V5, refrigerant flows to the outside air coil 110 which acts as a condenser, FIG. 2*f*. Solenoid operated control valve V2 is de-energized in this case and condensed liquid refrigerant passes to receiver 116 through line 182 and check valve 184. Further, the liquid refrigerant R from the receiver passes by way of liquid refrigerant line 162 through the accumulator and subcooler coils and by way of tap point 198 through line 194, check valve 200, solenoid operated control valve V1 (which is energized) and line 138 to the inside air coil which is now functioning as the system evaporator for cooling of the space 146 to be conditioned.

The presence of the check valve 142 prevents refrigerant flow to the inside hydronic coil 122, thus coil 122 does not function as an evaporator coil during this cooling mode. Cooling mode operation may be appropriately controlled in terms of multiple steps including either second to third stage operation by capacity control or cylinder removal from the compression process or speed change for the two speed motor 20. However, it is preferred that in cooling mode there is no speed change for northern latitude use.

Figure 2B:
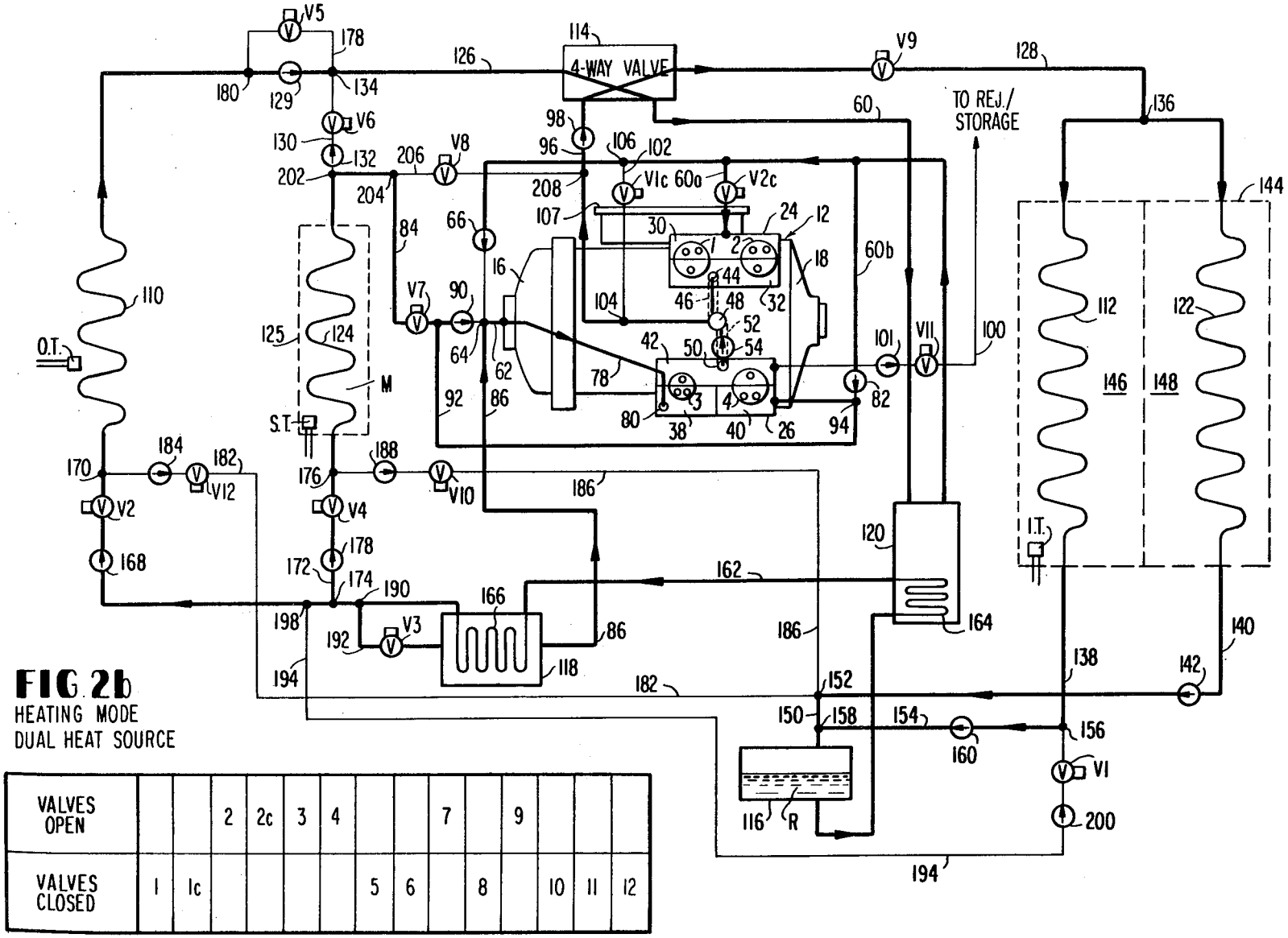
FIG. 2*b* is a schematic diagram of the improved trilevel, multiple cylinder reciprocating compressor heat pump system of FIG. 2 operating under heating mode with dual heat sources.
Figure 2C:
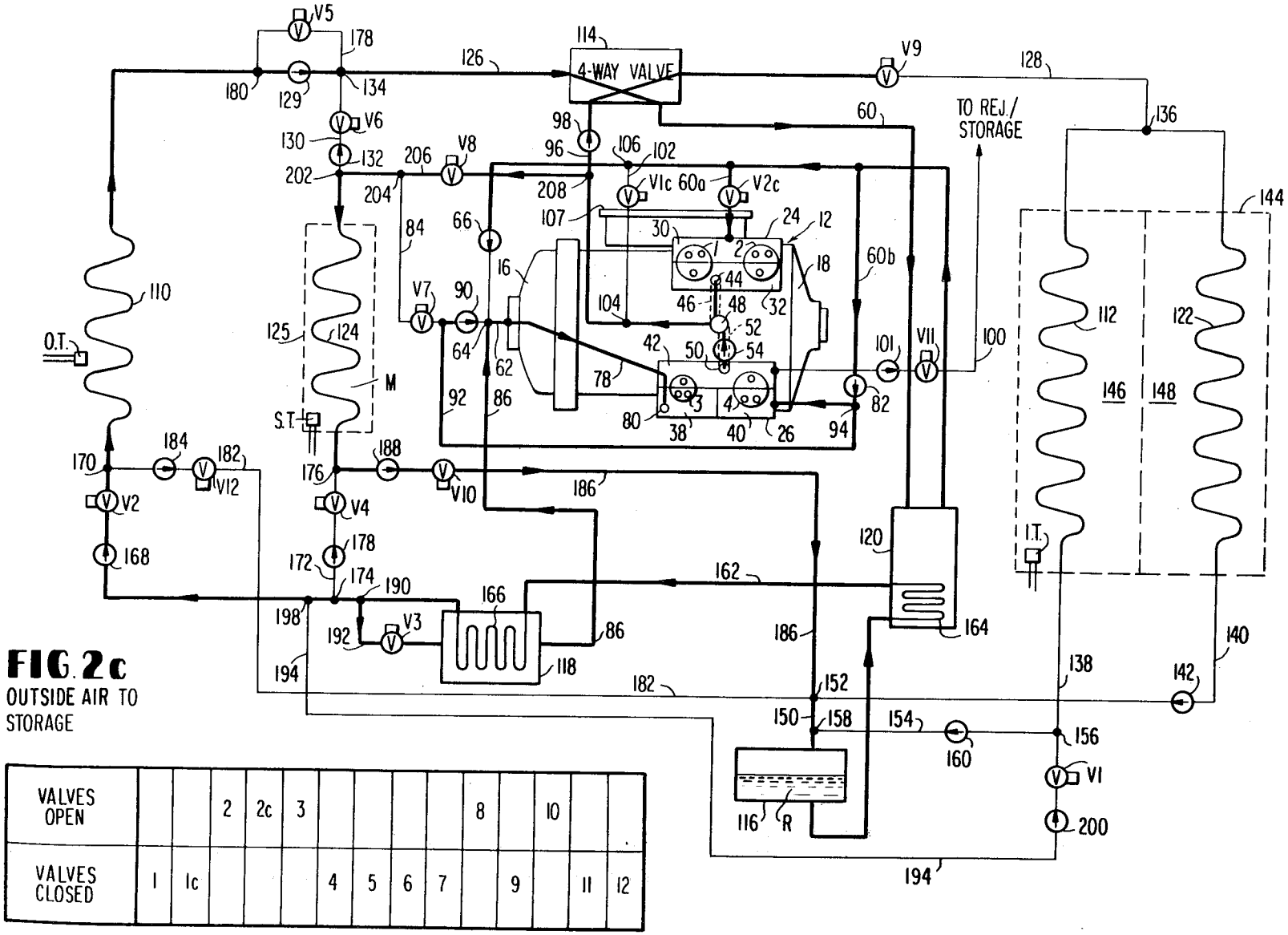
FIG. 2*c* is a schematic diagram of the improved trilevel, multiple cylinder reciprocating compressor heat pump system of FIG. 2 operating under heat storage mode.
Figure 2D:
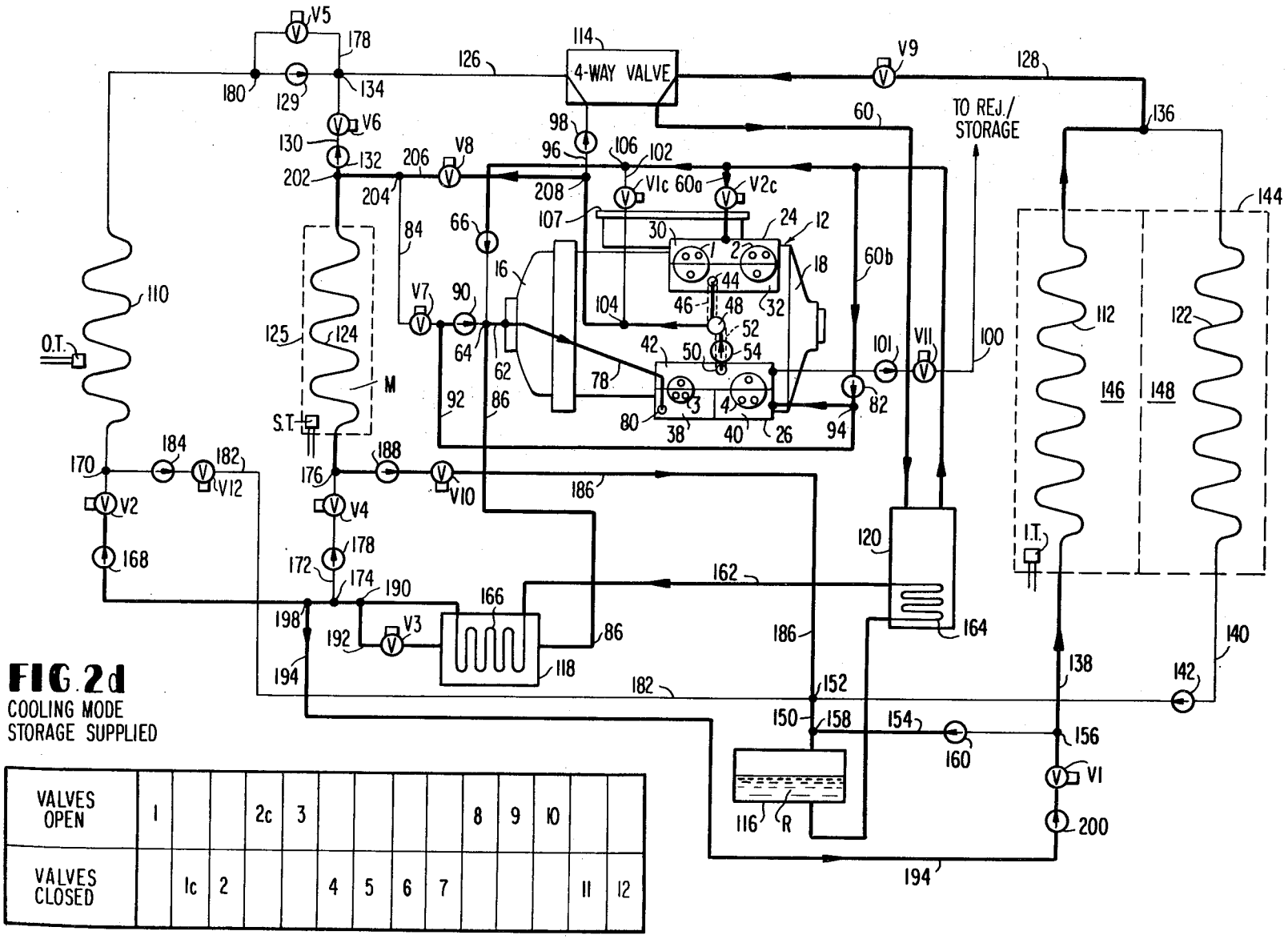
FIG. 2*d* is a schematic diagram of the improved trilevel, multiple cylinder reciprocating compressor heat pump system of FIG. 2 operating under cooling mode with heat storage.
Figure 2E:
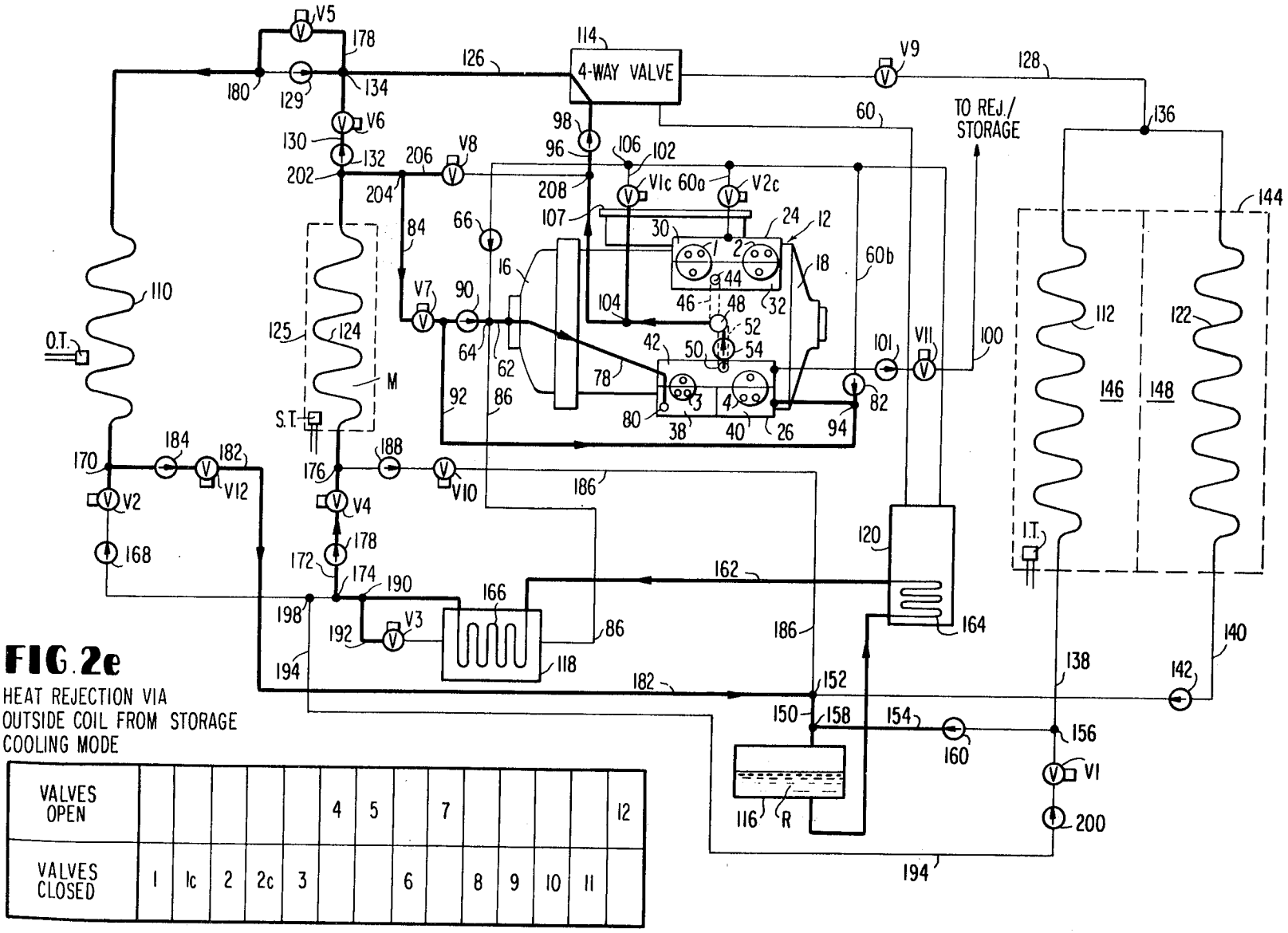
FIG. 2*e* is a schematic diagram of the improved trilevel, multiple cylinder reciprocating compressor heat pump system of FIG. 2 operating under heat rejection to ambient from storage.
Figure 2F:
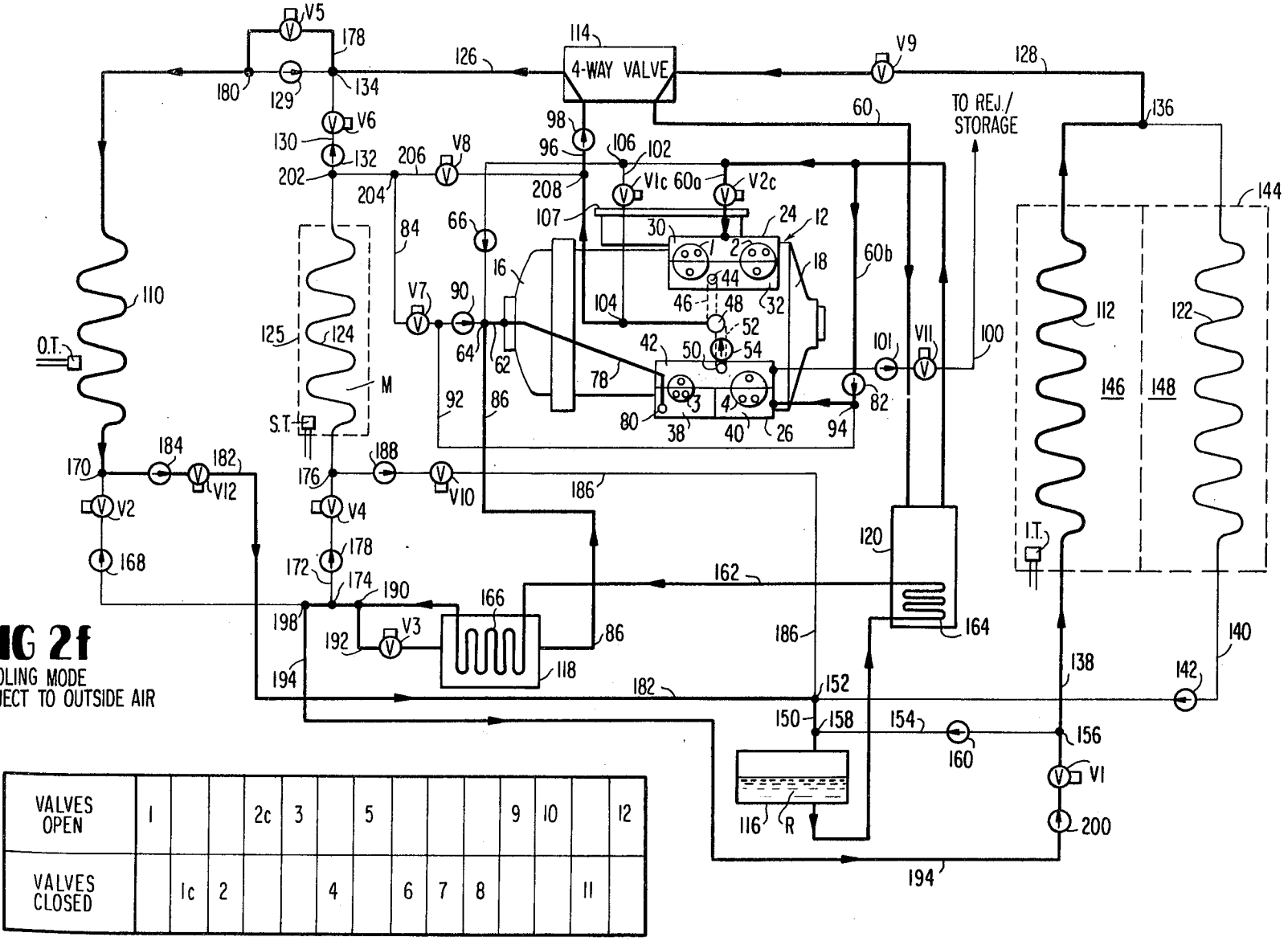
FIG. 2*f* is a schematic diagram of the improved trilevel multi-cylinder reciprocating compressor heat pump system of FIG. 2 operating under cooling mode with heat reject to outside air.
Figure 2G:
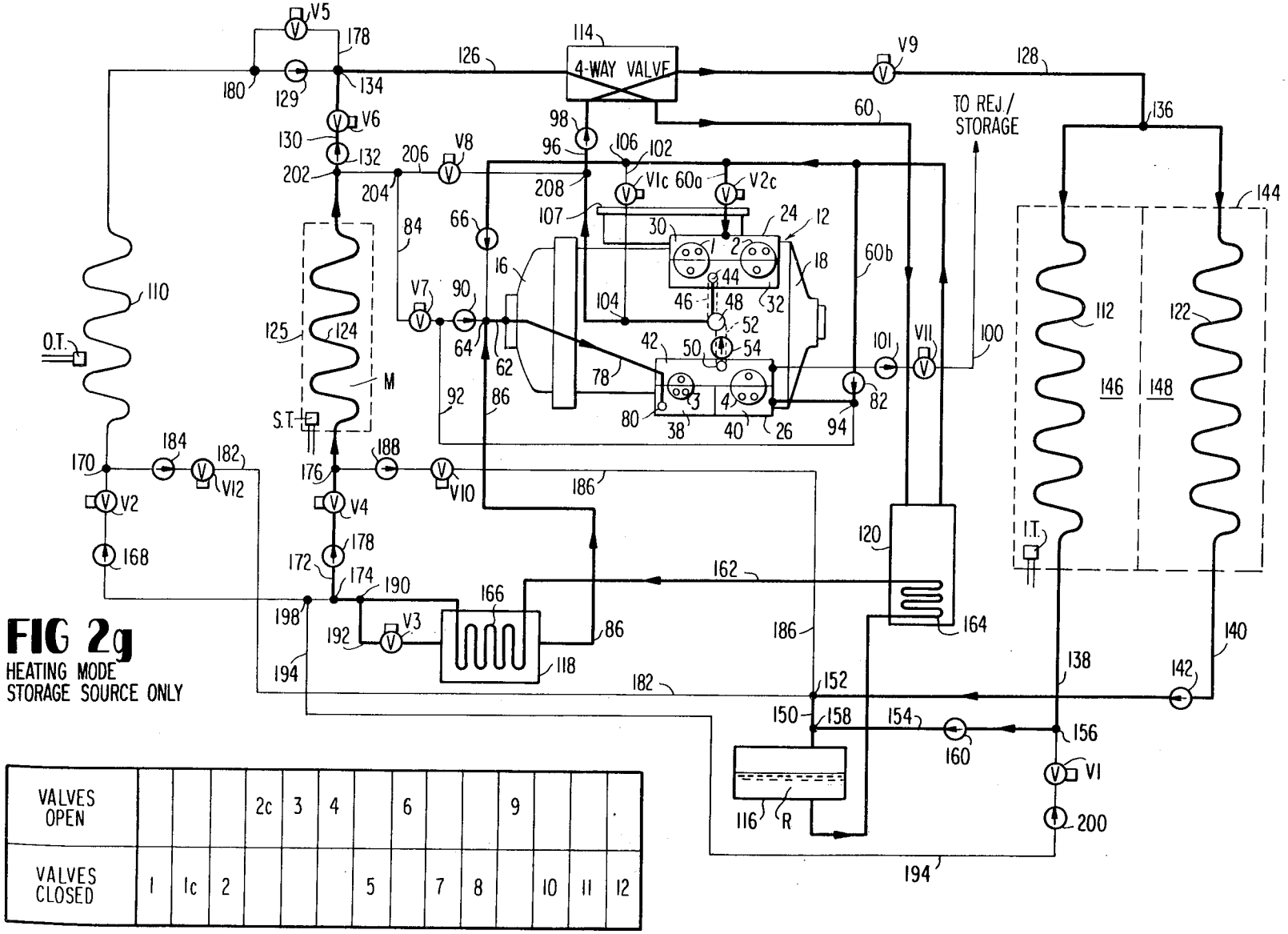
FIG. 2*g* is a schematic diagram of the improved trilevel multi-cylinder reciprocating compressor heat pump system of FIG. 2 operating under heating mode storage source only.
Figure 2H:
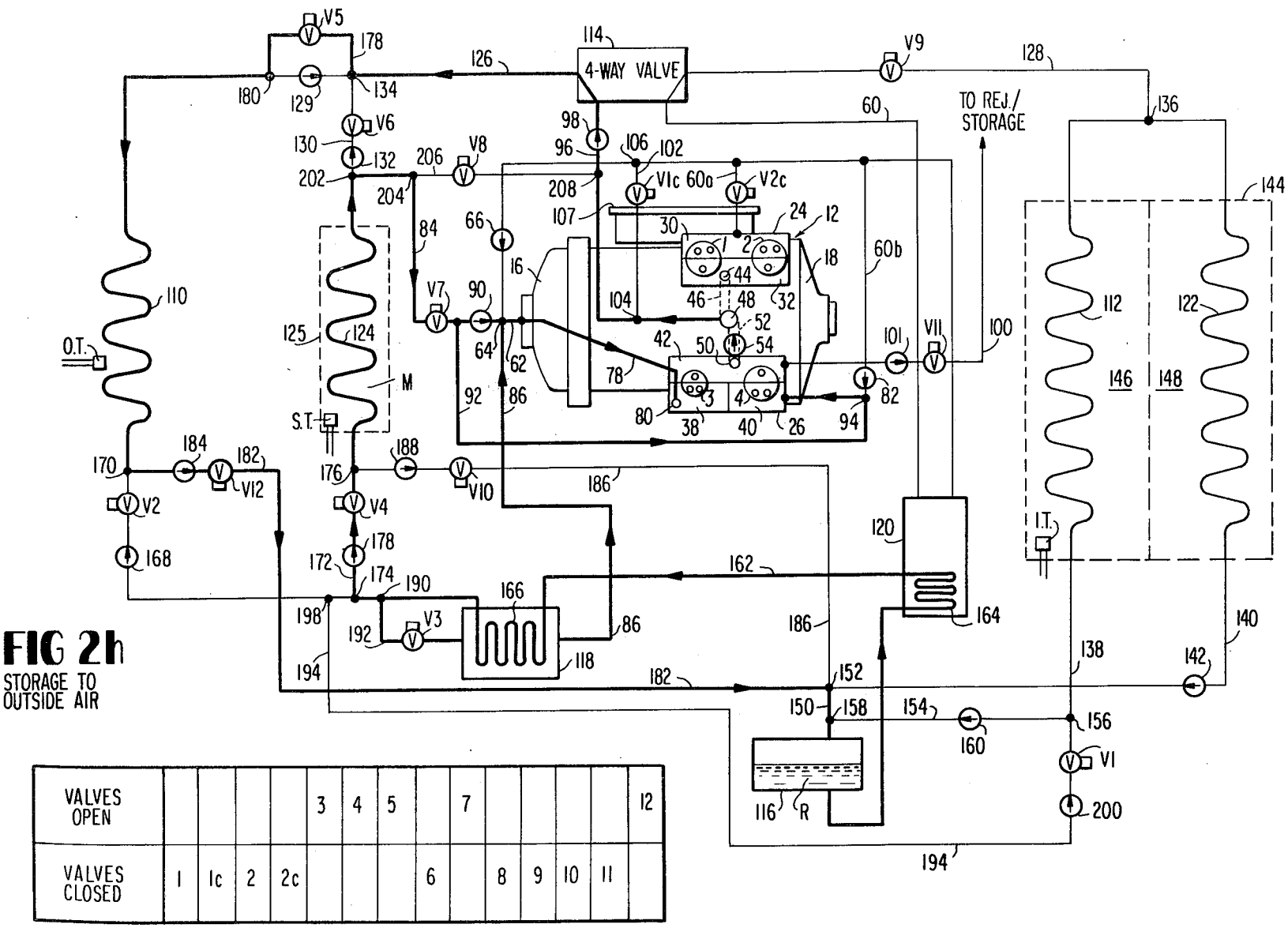
FIG. 2*h* is a schematic diagram of the improved trilevel multi-cylinder reciprocating compressor heat pump system of FIG. 2 operating under heat rejection mode storage to outside air.

The present invention advantageously incorporates a heat storage coil as at 124 for purposes of storing excess available heat under certain ambient FIG. 2*g*, and indoor, FIG. 2*d*, temperature conditions, for removing heat from storage when such heat is needed, FIGS. 2*b* and 2*h*, and for permitting temporary storage of heat which otherwise could be discharged to the atmosphere by way of the outside air coil 110 for instance, under low efficiency heat exchange conditions while permitting at a later time the discharge of the waste, stored heat under ambient temperature conditions more favorable to efficient surface heat transfer. For instance, in cooling the space to be conditioned at 146 within enclosure 144, because of high temperature ambient daytime conditions, system efficiency may be improved by rejecting heat from the refrigeration loop to storage media M by way of the storage coil 124 during the day, and subsequently removing heat from storage at night for discharge to the outside air under ambient temperature reduction on the order of 20° or so (the difference between daytime and night time ambient temperature).

Referring to FIG. 2*b*, the improved heat pump system of the present invention is shown under a heating mode condition, operating at high speed and with all four cylinders under the compression process. The operating conditions are not dissimilar from the third step heating as discussed with respect to FIG. 2*a*. However, in this case, solenoid operated control valve V4 is energized along with solenoid operated control valve V7 to permit thermal energy to be extracted from storage and delivered via the compressor to the inside air coil 112 and the inside hydronic coil 122 for heating respectively, enclosure spaces 146 and 148, along with heat extracted from the outside air by way of outside air coil 110. The system is shown after start up, so that solenoid operated control valve V1*c* is de-energized, while capacity control solenoid operated control valve V2*c* is energized and refrigerant within the suction return line 60 is available to all four cylinders, although under system operation as shown in FIG. 2*b*, the lower pressure suction gas returning by way of the four way valve 114 which is conditioned for heating mode will enter the low side 30 of cylinder head 24 for cylinders 1 and 2, but will be effectively blocked by way of check valves 66 and 82 from flowing to cylinders 3 and 4 respectively. Additionally, solenoid operated control valves V2 and V4 are energized, opening the outside air coil 110 and the storage coil 124 to the liquid refrigerant within the liquid refrigerant line 162 downstream of the subcooler 118. Refrigerant vapor returns from the outside air coil 110 through line 126 to the four way valve 114 while refrigerant returns from the storage coil (both storage coil 124 and the outside air coil 110 are acting as evaporators) by way of line 84 to the low side 40 of cylinder 4 of the compressor via line 92 upon energization of solenoid operated control valve V7 and de-energization of solenoid operated control valve V6, within lines 172 and 84, respectively.

Further, by energization of solenoid operated control valve V3, liquid refrigerant bled from the refrigerant line 162 and expanding within the subcooler and about subcooler coil 166, causes the intermediate pressure vapor to be returned via line 86 to connection point 64 where it enters the interior of the hermetic compressor unit 12 end bell 16 through line 62 and acts to cool the drive motor components and pressurize the crank case, entering the low side 38 of cylinder head 26 for recompression by cylinder 3 via port 80. The vapor pressure of the return from subcooler is higher than that of the refrigerant vapor within line 84 from the storage coil 124 or the refrigerant vapor within the suction return line 60 and thus check valves 90 and 66, respectively prevent refrigerant vapor from the storage coil and from the outside air coil from mixing with the subcooler return and passing through cylinder 3 for recompression.

It is noted that under this type of operation solenoid operated control valves **V1*c*, V1, V5, V6, V8, V10, V11, V12 are de-energized while as stated previously, solenoid operated control valves V2*c*, V2, V3, V4, V7 and V9 are energized. With change in inside load requirements and outside ambient temperature conditions, it may not be necessary to remove heat from storage, and in that case, solenoid operated control valves V4 and V7 may be de-energized forcing refrigerant to circulate only through the outside air coil 110 for picking up heat which is then directed to the inside air coil 112 and the inside hydronic coil 122 as discussed previously. Obviously, under the heating mode, the motor speed may be changed from high speed to low speed and vice versa and the compressor loaded or unloaded by removal of cylinders 1 and 2 from the compression process under automatic control provisions in response to temperature sensed by the outside thermostat OT and the inside thermostat IT adjacent coil 110 and within enclosure space 146**.

Alternatively, it may be desired that the storage coil 124 carry the load totally due to unfavorable ambient air conditions, in which case solenoid operated control valves 2 and 7 would be de-energized, while solenoid operated control valves 4 and 6 would be energized, terminating refrigerant flow from the liquid refrigerant line 162 to the outside air coil 110 and causing all of the liquid refrigerant to be directed to the storage coil 124, whereupon by expansion thermal energy is picked up from storage and directed to all four cylinders (if desired by energization of the capacity control solenoid operated control valve **V2*c*) through four way valve 114 and by way of the suction return line 60**.

Further, it is apparent that if the pressure level in the return line from the storage coil 124 were sufficiently high, in comparison to the pressure of the refrigerant vapor within line 86 returning from the subcooler 118, some of the refrigerant vapor would flow through check valve 90 to mix with the subcooler return vapor and enter through the hermetic compressor unit 12 and low side 38 leading to cylinder 3, while the remaining refrigerant vapor returning to the compressor from storage would pass through line 92 to the low side 40 of the same cylinder head 26 for recompression by cylinder 4.

Turning next to FIG. **2*c*, the heat pump system of the present invention is illustrated again under a heating mode. However, in this case there are no heating or cooling requirements for the enclosure 144 and specifically the spaces 146 and 148 to be conditioned. However, thermal energy is available from the outside air under favorable system efficiency conditions to permit that thermal energy to be stored by way of storage coil 124. In this mode of operation, solenoid operated control valves V1*c*, V1 (and for purposes of illustration), V4, V5, V6, V7, V11, V12 are de-energized, while solenoid operated control valves V2*c*, V2, V3, V8 and V10 are energized. Since the outdoor air coil 110 is acting as an evaporator and an outdoor air heat source, the vaporized refrigerant returning to the compressor by way of the four way valve 114 is directed through the suction return line 60 to all four cylinders since solenoid control valve V2*c* is energized and refrigerant is available to cylinders 1 and 2 through line 68. With the solenoid operated control valve V3 energized, there is refrigerant for subcooling, and check valve 66 prevents refrigerant vapor within the suction return line 60 entering end bell 16 of the hermetic compressor unit 12 for cooling of the motor windings, pressurization of the compressor crank case and movement to the low side 38 of the cylinder head 26 by way of port 84 compression by cylinder 3, this being achieved by subcooler return vapor at relatively high pressure. Cylinder 4 is fed through line 60*b***.

The compressed refrigerant vapor at high pressure being discharged from the discharge manifold 48 by way of line 96 cannot pass to the inside air coil 112 and the inside hydronic coil 122 since the solenoid operated control valve V9 is de-energized. However, since solenoid operated control valve V8 is energized, this opens line 206, leading to one side of the storage coil 124, permitting compressed refrigerant vapor to enter the storage coil for condensation therein and transfer of heat to the storage media M. With the solenoid operated control valve V4 de-energized, refrigerant return from the storage coil is permitted through line 186 and check valve 188 to the receiver, the liquid refrigerant R within the receiver flows through the accumulator coil 164 and subcooler coil 166 with excellent subcooling and to the outside air coil 110 which is acting as the evaporator for the system, since solenoid operated control valve V2 is energized. Heat is absorbed from the atmosphere and the refrigerant vapor returns through check valves 129 and line 126 through the four way valve 114, where after passing through accumulator 120 it enters cylinders 1, 2 and 4 of the compressor for recompression. Thus, the storage tank temperature can be built up under mild temperature conditions where there is no system requirement to either cool or heat the enclosure spaces 146 and 148 and flow to the inside air cool 112 and the inside hydronic coil 122 can be terminated. Operation can be effected at low or high speed and with two or more cylinders.

As discussed previously, the improved heat pump system of the present invention may be advantageously employed to effect daytime cooling of the enclosure 144 and particularly space 146 by operating the system under a cooling mode in which the inside air coil 118 functions as the system evaporator. However, it may be under given ambient condition, that it will be required during the night to in fact add heat by reversing the system and employing the inside air coil 112 and the inside hydronic coil 122 as condensers. Under such conditions, it is preferred that the heat removed from the space, such as 146 to be conditioned during daytime, be stored by storage coil 124 during the day and then removed from storage under relatively high thermal efficiency conditions and supplied to the enclosure 144 at night rather than extract heat from the atmosphere by way of the outside air coil 110. During daytime, therefore, referring to FIG. 2*d*, under the certain ambient temperature conditions, heat may be stored within the storage media in comparison to the ambient heat rejection conditions, solenoid operated control valves V1*c*, V2, V4, V5, V7, V6, V11,V12 are de-energized, while solenoid operated control valves V2*c*, V1, V3, V8, V9 and V10 are energized. The four way control valve is shifted to cooling mode operation such that discharge line 96 is connected to line 126 leading to the storage coil 124, while the line 128 including the solenoid operated control valve V9 is connected to the suction return line 60. With solenoid operated control valve 5 de-energized, outside air coil 110 cannot act as a waste heat discharge and the heat is stored by the storage media M with all refrigerant flow from the compressor passing through the storage coil 124 via line 206 and control valve V8, with solenoid operated control valve V6 closed. Energization of solenoid operated control valve V10 permits the condensed refrigerant to pass through the receiver 116 where the liquid refrigerant after passing through the accumulator and subcooler coils 164 and 166 and being subcooled is directed by way of line 194, with the solenoid operated control valve V1 energized, to the inside air coil 112 where the liquid refrigerant is expanded; coil 112 functioning as an evaporator for cooling the enclosure space 146.

The compressor is operating at full capacity with solenoid operated control valve V2*c* energized and line 60*a* open. Solenoid operated control valve V3 is also energized so that the subcooler is operating to subcool the liquid refrigerant being fed in this case to the inside air coil 112, and wherein the refrigerant vapor returning by way of subcooler return line 86 to the compressor feeds to cylinder 3 through the hermetic casing. Being at a higher pressure than that of the suction return line 60, it thus pressurizes the crank case and prevents, because of check valve 66, refrigerant vapor within the return line 60 from mixing with the subcooler return vapor and passing to cylinder 3 via cylinder head low side 38.

Again, temperature signals emanating from the outside thermostat OT and the inside thermostat IT control the energization of the solenoid operated control valves and the shifting of the four way valve between heating and cooling modes. Obviously, with the suitable control unit 107, compressor 22 and the system components, the system can operate unloaded with two cylinders, loaded with four cylinders, as the case may be, and at high or low speed with heat being added to storage and removed from the space 146 being conditioned with the inside air coil functioning as the evaporator for the closed loop system.

FIG. 2*d* represents operation under four cylinders with the two speed motor 20 operating at high speed. The system controls may be such that under cooling mode, the motor would always operate at low speed and there would be either two cylinders operating or four cylinders depending upon energization of the solenoid operated control valve 2*c*. Further, while the illustrated system preferably employs a control program via unit 107, where solenoid operated control valves V2*c* and V3 are energized simultaneously and de-energized simultaneously, this could be modified to permit full capacity operation for the compressor but without subcooler operation in which case solenoid operated control valve V2*c* would be energized but solenoid operated control valve V3 would remain de-energized.

Further with respect to the system operating in accordance with FIG. 2*d*, while during the day the system operates under a cooling mode to provide light cooling to the space 146 of the enclosure 144 under mild ambient conditions, it may be necessary at night to in fact heat the same space which was cooled during the daytime. This is achieved, FIG. 2*f*, by simple reversal of the four way valve from cooling mode to heating mode, wherein the discharge line 96 is connected to line 128 while the line 126 is connected to the suction return line 60. The thermostat ST or other temperature sensitive device sensing the temperature of the storage media M within the storage device 125 causes, under programmed control, at unit 107 the selection of the storage coil 124 as the source of that heat rather than the outside air coil 110. The storage coil then acts as the evaporator for the system with the inside air coil 112 and the inside hydronic coil 122 acting as condensers. Vaporized refrigerant is returned to the compressor through line 172 with the solenoid operated control valves V4 and V6 energized, solenoid operated control valve V10 de-energized and directing the refrigerant to the compressor through the suction return line 60. Assuming again that the compressor is operating with all four cylinders 1, 2, 3 and 4 involved in the compression process, and with the subcooler operating by energization of solenoid operated control valve V3 refrigerant vapor is returned to compressor cylinders 1, 2 and 4 by way of the suction return line 60 and lies 60*a* and 60*b*. The subcooler return vapor being at a higher pressure than that of the suction return line 60 causes the check valve 66 to operate to prevent refrigerant vapor flow from the suction return line 60 to cylinder 3 but permits that cylinder 3 to receive all of the vapor returned from the subcooler.

Reference to FIG. 2*e* shows the system operating in a heat rejection mode wherein the heat previously stored within the storage media is removed from storage by operation of the storage coil 124 as an evaporator and with the outside air coil 110 being employed as a heat reject condenser. No heating or cooling requirements exist for the enclosure 144 although the system permits the inside air coil 112 and the inside hydronic coil 122 to function as condensers for heating spaces 146 and 148, if desired, while at the same time dissipating heat from storage to the outdoor air, or alternatively, refrigerant may be directed reversely through the indoor air coil 112 to effect an evaporation action and removal of heat from the space 146 while still dissipating heat from storage to the outside air through outdoor air coil 110.

However, in the illustrated embodiment of the present invention, as per FIG. 2*e*, only solenoid operated control valves V4, V5, V7, V12 are energized, while solenoid operated control valves V1*c*, V2*c*, V1, V2, V3, V6, V8, V9, V10 and V11 are de-energized. The machine is operating at low speed (or perhaps under high speed conditions) but with solenoid operated control valve V2*c* de-energized refrigerant vapor returning from the storage coil 124 after vaporization and pick up of heat returns through line 84, check valve 90 and line 62 to end bell 16, passing over the motor components for cooling the same, entering the compressor crank case and also passing to cylinder 3 via port 80 for recompression, while a further portion of that refrigerant vapor passes through line 92 to the low side 40 of the compressor head 26 for recompression by way of cylinder 4 and for common discharge from the high side 42 of that cylinder to discharge line 96 via discharge manifold 48.

The compressed refrigerant vapor passes through check valve 98 and through the four way valve 114 to line 126 since lines 96 and 126 are connected by the four way valve 114 with the four way valve in cooling mode position. The energization of the solenoid operated control valve V5 permits the refrigerant vapor to flow to the outside air coil 110, now acting as the system condenser, and discharging the heat at relatively low temperature night time ambient conditions with the temperature in the range of 70° to 75° F. The condensed refrigerant flows through the check valve 184 to the receiver 116 via line 182. Liquid refrigerant R returns to the storage coil 124 for vaporization, through liquid refrigerant line 162 and passage through accumulator coil 164 and subcooler coil 166. With the solenoid operated control valves V2*c* and V3 de-energized, obviously there is no liquid refrigerant for subcooling purposes and no subcooling return vapor within return line 86. Heat is then dissipated from the storage coil under low motor load and high system efficiency conditions. Solenoid operated control valve V12 within line 182 is open.

With respect to the illustrated embodiment of the invention and the various modes of operation, it may be appreciated that additional changes both in the control format and in the structural aspects of the heat pump system and the compressor may be made without departing from the spirit of this invention. For instance, the invention is broadly directed to a heat pump system incorporating a multi-cylinder reciprocating compressor and the compressor in simplified form may comprise three cylinders or four cylinders. However, multiple cylinders performing the function of a given first, second, third and fourth cylinder may be accomplished in commercial practice, particularly for large heat pump systems. For instance, the compressor may constitute more than two cylinder heads or may be three, six, nine or twelve cylinders, or a four cylinder machine may be enlarged to incorporate eight or twelve cylinders acting in banks of two and three respectively and functioning for the individual cylinders of the four cylinder reciprocating compressor illustrated in the embodiment of the invention found within the drawings. Further, indoor and outdoor thermostats and a media thermostat supply control signals to the control unit 107, and solenoid operated control valves control the flow of refrigerant within the circuit. The control valves could be other than solenoid operated, and the control scheme can be modified to accomplish the same purposes without departing from the invention. The two speed motor preferably comprises a single phase alternating current motor but obviously it could be a two phase, a three phase, or a direct current motor.

In a typical control format for operating control device 107, the connections to the various solenoid operated control valves and based on inputs received from the storage thermostat ST, outdoor thermostat OT and indoor thermostat ID, are provided in the chart below.

TYPICAL SYSTEM CONTROL FORMAT

| | Outside Air Thermostat | |
|---|---|---|
| Indoor Thermostat | Moderate Ambient | Low Ambient |
| Neutral Position | Unit Off | 3 & 4 Low Speed |
| First Step Heat | 3 & 4 Low Speed | 1, 2, 3 & 4 Low Speed Subcooler if Air Source |
| Second Step Heat | 1, 2, 3 & 4 Low Speed (No Subcooler) | 1, 2, 3 & 4 High Speed Subcooler ON |

While the invention has been particularly shown and described with reference to a preferred embodiment thereof, it will be understood by those skilled in the art that various changes in form and details may be made therein without departing from the spirit and scope of the invention.

What is claimed is:

1. An air source heat pump system comprising:

a first heat exchanger forming an indoor coil, a second heat exchanger forming an outdoor coil, a third intermediate pressure evaporator coil, a multi-cylinder reciprocating compressor, conduit means carrying refrigerant and connecting said coils and said compressor in a closed fluid circuit, said conduit means including a reversing valve for connecting said indoor and outdoor coils in a closed series loop, with said reversing valve functioning to cause said indoor and outdoor coils to operate alternately as a low pressure system evaporator or a high pressure system condenser, and means for selectively supplying refrigerant to said intermediate pressure evaporator coil for vaporization therein, the improvement wherein:

said multi-cylinder reciprocating compressor comprises a hermetic compressor unit including:

a hermetic casing, at least three cylinders within said casing, pistons within said cylinders, a motor within said casing for driving said reciprocating compressor pistons and being operatively coupled thereto, said conduit means including first conduit means for supplying low pressure suction return refrigerant vapor from said system evaporator to said hermetic casing for flow over the motor to cool said motor and thence to a first cylinder for recompression, means for supplying intermediate pressure refrigerant vapor from said intermediate pressure evaporator coil to said first conduit means for flow to said first cylinder, means for selectively cutting off said first cylinder to suction return refrigerant vapor from said system evaporator, and means for selectively directing low pressure, suction return refrigerant vapor from said system evaporator to all of said at least three cylinders, said second and third cylinders only, and said third cylinder only, such that said compressor may be operated at partial load conditions with low pressure refrigerant vapor compressed by said first and second cylinders and under increased load conditions with said low pressure, suction return refrigerant vapor compressed by said second and third cylinders and said intermediate pressure refrigerant vapor from said intermediate pressure evaporator coil compressed by said first cylinder with said third cylinder functioning in a capacity control mode.

2. The air source heat pump system as claimed in claim 1, wherein said compressor drive motor comprises a two speed motor, and said system comprises control means for operating said motor at low speed with said first and second cylinders connected to said system evaporator under low system load conditions, at low speed, with said first, second and third cylinders connected to said system evaporator under intermediate load conditions, and with said motor operating at high speed and said second and third cylinders connected to said system evaporator and said first cylinder connected to said intermediate pressure evaporator coil to thereby provide three step compressor loading.

3. The air source heat pump system as claimed in claim 1, further comprising means for feeding the refrigerant vapor passing over said motor windings to the crank case of said multiple cylinder reciprocating compressor to assure wrist pin load reversal for all of said compressor cylinders and to said first cylinder for recompression.

4. The air source heat pump system as claimed in claim 2, further comprising means for feeding the refrigerant vapor passing over said motor winding to the crank case of said multiple cylinder reciprocating compressor to assure wrist pin load reversal for all of said compressor cylinders and to said first cylinder for recompression.

5. The air source heat pump system as claimed in claim 1, wherein said conduit means includes a suction line leading from said reversing valve to at least one of said cylinders, a discharge line leading from the discharge side of all of said compressor cylinders to said reversing valve for supplying compressed refrigerant vapor to the system condenser regardless of system mode, and wherein said system includes a shorting line connecting said discharge line to said suction line and said shorting line carries a solenoid operated control valve for selectively opening the shorting line to permit the compressor drive motor to be energized with all compressor cylinders fully unloaded.

6. The air source heat pump system as claimed in claim 2, wherein said conduit means includes a suction line leading from said reversing valve to at least one of said cylinders, a discharge line leading from the discharge side of all of said compressor cylinders to said reversing valve for supplying compressed refrigerant vapor to the system condenser for the system regardless of system mode, and wherein said system includes a shorting line connecting said discharge line to said suction line and said shorting line carries a solenoid operated control valve for selectively connecting the suction and discharge lines together to permit the compressor drive motor to be energized with all compressor cylinders fully unloaded.

7. The air source heat pump system as claimed in claim 4, wherein said conduit means includes a suction line leading from said reversing valve to at least one of said cylinders, a discharge line leading from the discharge side of all of said compressor cylinders to said reversing valve for supplying compressed refrigerant vapor to the system condenser for the system regardless of system mode, and wherein said system includes a shorting line connecting said discharge line to said suction line and said shorting line carries a solenoid operated control valve for selectively opening the shorting line to permit the compressor drive motor to be energized with all compressor cylinders fully unloaded.

8. The air source heat pump system as claimed in claim 1, wherein said intermediate pressure evaporator coil comprises a subcooler, and wherein said conduit means further comprises means for connecting said subcooler between said inside and outside air coils, wherein a portion of liquid refrigerant within said conduit means for cooling said subcooler coil returns as intermediate pressure vapor from said subcooler, over said motor to said first cylinder, and said means for selectively cutting off the first cylinder comprising a check valve within said means leading from said reversing valve to said hermetic casing such that evaporator suction return refrigerant vapor flows to said hermetic casing for cooling said motor and for recompression by said first cylinder only in the absence of subcooler operation.

9. The air source heat pump system as claimed in claim 1, further comprising a storage coil, a thermal energy storage media in heat transfer relation with respect to said storage coil for supplying heat to said storage coil or removing heat therefrom, and said conduit means includes means for connecting said storage coil in parallel with said outside air coil and valve means for selectively including or excluding said outdoor coil and said storage coil within said circuit for supplying heat to said refrigerant simultaneously with that supplied by the outside air coil or exclusive thereof under heat pump system heating mode, and for removing heat from the system either simultaneously with the outside air coil or exclusive of said outside air coil when said heat pump system is operating under cooling mode.

10. The air source heat pump system as claimed in claim 1, further comprising an inside hydronic coil in parallel with said inside air coil and acting to heat a space separate from that heated by said inside air coil during operation of said heat pump system in heating mode, and wherein said conduit means further comprises a check valve for preventing liquid refrigerant flow to the inside hydronic coil when said heat pump system operates under cooling mode and said inside air coil acts as the system low pressure evaporator.

11. The air source heat pump system as claimed in claim 1, further comprising means for connecting the compressor discharge line to said storage coil and means for selectively causing said outside air coil to act as an evaporator, connecting the compressor discharge line to said outside air coil and causing said storage coil to act as an evaporator such that thermal energy may be removed from the outside air by said outside coil and stored within said storage media or discharged therefrom through said outside coil regardless of any heating or cooling function of said inside air coil and/or said inside hydronic coil.

12. The air source heat pump system as claimed in claim 1, further comprising means for selectively causing refrigerant to flow through said storage coil while preventing flow of refrigerant through said outside air coil to force said storage coil to function as an evaporator and supply heat to said inside air coil and means for selectively causing refrigerant to flow through said storage coil to force said storage coil to function as a condenser to heat said storage media with said inside air coil acting as an evaporator.

13. The air source heat pump system as claimed in claim 1, wherein said compressor comprises plural cylinder heads, at least said first and second cylinders are located within said first cylinder heat, said third cylinder is located within said second cylinder head, manifold means for said cyinder heads defining separate inlets and a common outlet for said first and second cylinders and separate inlet and outlet for said third cylinder, a first discharge line leading from said common outlet for said first and second cylinders, a second discharge line leading from the outlet of said third cylinder, a common discharge manifold connected to said first and second discharge lines, a check valve within one of said lines for permitting compressor discharge flow from one cylinder outlet to said common discharge manifold but preventing reverse flow, and a heat rejector/storage line connected to said one outlet of one of said cylinder heads such that the discharge from a selected cylinder head may be supplied to a low pressure condenser, while compressor discharge from the other cylinder head may be directed to the coil functioning as the system high pressure condenser.

14. The air source heat pump system as claimed in claim 13, wherein said second cylinder has a given compression displacement, said first cylinder has a displacement less than that of said second cylinder and said third cylinder has a displacement which is at least equal to that of said second cylinder.

15. The air source heat pump system as claimed in claim 14, wherein said second and third cylinders are of a given diameter and said first cylinder has a diameter which is less than that of said second cylinder, and wherein the pistons of said first, second and third cylinders have equal strokes.

16. A hermetic multi-cylinder reciprocating compressor unit for an air source heat pump system, said system comprising:

a first heat exchanger forming an indoor coil, a second heat exchanger forming an outdoor coil, a third intermediate pressure evaporator coil, conduit means carrying refrigerant and connecting said coils and said compressor in a fluid circuit, said conduit means including a reversing valve for connecting said indoor coil and said outdoor coil in a closed series loop with said reversing valve functioning to cause said indoor and outdoor coils to operate alternately as a low pressure system evaporator or a high pressure system condenser, said conduit means including means for selectively supplying refrigerant to said intermediate pressure evaporator coil for evaporation therein, said compressor unit comprising:

a hermetic casing, at least three compressor cylinders within said casing, pistons within said cylinders, and means for operatively connecting said motor to said pistons for effecting compression within said at least first, second and third cylinders, and said unit comprising first conduit means for connecting said first cylinder to said coil acting as the system evaporator to receive low pressure refrigerant vapor therefrom, second conduit means for connecting said intermediate pressure evaporator coil to said first conduit means for flow to said first cylinder to receive intermediate pressure refrigerant vapor therefrom, a check valve within said first conduit means for preventing low pressure refrigerant vapor flow from said system evaporator to said first cylinder when intermediate pressure refrigerant vapor returns from said intermediate pressure evaporator coil to said first cylidner when said means for selectively supplying refrigerant to said intermediate pressure evaporator coil is in operation, third conduit means for connecting said second cylinder to said system evaporator, and fourth conduit means for selectively connecting said third cylinder to said system evaporator such that under partial load conditions, said first and second cylinders receive low pressure refrigerant vapor from said system evaporator, and under increased load conditions, said second and third cylinders receive low pressure refrigerant vapor from said system evaporator and said first cylinder receives intermediate pressure refrigerant from said intermediate pressure evaporator coil such that said compressor unit operates under two step loading with high system efficiency.

17. The hermetic reciprocating compressor unit as claimed in claim 16, wherein said compressor comprises plural cylinder heads, at least said first and second cylinders are located within said first cylinder head, said third cylinder is located within said second cylinder head, manifold means for said cylinder heads defining separate inlets and a common outlet for said first and second cylinders and separate inlet and outlet for said third cylinder, a first discharge line leading from said common outlet for said first and second cylinders, a second discharge line leading from the outlet of said third cylinder, a common discharge manifold connected to said first and second discharge lines, a check valve within one of said discharge lines for permitting compressor discharge flow from one cylinder outlet to said common discharge manifold but preventing reverse flow, and a heat rejector/storage line connected to said one outlet of one of said cylinder heads such that the discharge from a selected cylinder head may be supplied to a low pressure condenser, while compressor discharge from the other cylinder head may be directed to the coil functioning as the system high pressure condenser.

18. The hermetic reciprocating compressor unit as claimed in claim 16, wherein said second and third cylinders each have a given compression displacement and said first cylinder has a displacement less than that of said second or third cylinder.

19. The hermetic reciprocating compressor unit as claimed in claim 18, wherein said second and third cylinders are of given diameter and said first cylinder has a diameter which is less than that of said second cylinder, and wherein the pistons of said first, second and third cylinders have equal strokes.

20. The hermetic reciprocating compressor unit as claimed in claim 17, wherein said second and third cylinders have a given compression displacement and said first cylinder has a displacement less than that of said second or third cylinder.

21. The hermetic reciprocating compressor unit as claimed in claim 20, wherein said second and third cylinders are of given diameter, said first cylinder has a diameter which is less than that of said second or third cylinder, and wherein the pistons of said first, second and third cylinders have equal strokes.

22. In a refrigeration system comprising:

a first heat exchange coil, a second heat exchange coil, a third intermediate pressure evaporator heat exchange coil, a multi-cylinder reciprocating compressor, conduit means carrying refrigerant and connecting said coils and said compressor in a closed fluid circuit, said conduit means including means for connecting said first and second coils and said compressor in a closed series loop with one of said first and second coils acting as the system evaporator and the other of said first and second coils acting as a system condenser, and means for selectively supplying liquid refrigerant to said intermediate pressure evaporator coil for vaporization therein, the improvement wherein:

said multi-cylinder reciprocating compressor comprises at least three cylinders, said conduit means including first conduit means for supplying low pressure suction return refrigerant vapor from said coil acting as said system evaporator to a first cylinder for recompression, means for supplying intermediate pressure refrigerant vapor from said intermediate pressure evaporator coil to said first conduit means for flow to said first cylinder, and means for selectively cutting off said first cylinder to suction return refrigerant vapor from said system evaporator when said first cylinder is receiving refrigerant vapor from said intermediate pressure evaporator, and means for selectively directing low pressure, suction return refrigerant vapor from system evaporator to all of said three cylinders, said second and third cylinders only, and said third cylinder only, such that said compressor may be operated at partial load conditions with low pressure, refrigerant vapor compressed by said first and second cylinders and under increased load conditions with said low pressure, suction return refrigerant vapor compressed by said second and third cylinders and said intermediate pressure refrigerant vapor from said intermediate pressure evaporator coil compressed by said first cylinder with said third cylinder functioning in a capacity control mode.

23. The refrigeration system as claimed in claim 22, wherein said compressor includes a two speed drive motor, and said system comprises control means for operating said motor at low speed with said first and second cylinders connected to said system evaporator under low system load conditions, at low speed with said first, second and third cylinders connected to said system evaporator under intermediate load conditions, and at high speed with said second and third cylinders connected to said system evaporator and said first cylinder connected to said intermediate pressure evaporator coil to thereby provide three step compressor loading.

24. The refrigeration system as claimed in claim 22, wherein said intermediate pressure evaporator coil comprises a subcooler coil, and wherein said conduit means further comprises means for connecting said subcooler coil between said first and second heat exchange coils and for returning vaporized refrigerant employed in cooling the liquid refrigerant within said subcooler coil as intermediate pressure vapor from said subcooler to said first cylinder, and said means for selectively cutting off said first cylinder comprises a check valve within said conduit means leading from said heat exchange coil functioning as the system evaporator to said compressor first cylinder, such that evaporator suction return refrigerant vapor flows to said compressor for recompression by said first cylinder only in the absence of subcooler operation.

25. The refrigeration system as claimed in claim 24, further comprising a storage heat exchange coil, a thermal energy storage media in heat transfer relation with respect to said storage coil for supplying heat to said storage coil or removing heat therefrom, and said conduit means includes means connecting said storage coil within said closed loop for supplying heat to said refrigerant within said closed loop or extracting heat therefrom.

26. The refrigeration system as claimed in claim 22, wherein said compressor comprises; plural cylinder heads, at least said first and second cylinders are located within said first cylinder head, said third cylinder is located within said second cylinder head, manifold means for said cylinder heads define separate inlets and a common outlet for said first and second cylinders and a separate inlet and outlet for said third cylinder, a first discharge line leading from said common outlet for said first and second cylinders, a second discharge line leading from the outlet of said third cylinder, a common discharge manifold connected to said first and second discharge lines, a check valve within one of said lines for permitting compressive discharge flow from one cylinder outlet to said common discharge manifold, but preventing reverse flow, and a heat rejector/storage line connected to said one outlet of one of said cylinder heads, such that the discharge from a selected cylinder head may be supplied to one of said coils forming a low pressure condenser, while compressor discharge from the other cylinder head may be directed to the heat exchange coil functioning as the system high pressure condenser.

27. The refrigeration system as claimed in claim 26, wherein said second cylinder has a given compression displacement, said first cylinder has a displacement less than that of said second cylinder, and said third cylinder has a displacement which is at least equal to that of said second cylinder.

28. The refrigeration system as claimed in claim 27, wherein said second and third cylinders are of a given diameter and said first cylinder has a diameter which is less than that of said second cylinder, and wherein the pistons of said first, second and third cylinders have equal strokes.

29. The refrigeration system as claimed in claim 26, further comprising a storage coil, a thermal energy storage media in heat transfer relation with respect to said storage coil for supplying heat to said storage coil or removing heat therefrom, and said heat rejector/storage line connected to said one outlet of one of said cylinder heads connects to said storage coil such that said storage coil functions as a low pressure condenser while compressor discharge from the other cylinder head is directed to one or the other of said first and second coils which functions as the system high perssure condenser.

* * * * *